US011613967B2

(12) United States Patent
Hora et al.

(10) Patent No.: US 11,613,967 B2
(45) **Date of Patent: *Mar. 28, 2023**

(54) BOTTOM HOLE ASSEMBLY WITH A CLEANING TOOL

(71) Applicant: Weatherford Technology Holdings, LLC, Houston, TX (US)

(72) Inventors: Kenneth D. Hora, Houston, TX (US); Michael Smalley, Houston, TX (US); David W. Teale, Spring, TX (US); James H. Taylor, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 17/332,565

(22) Filed: May 27, 2021

(65) Prior Publication Data

US 2021/0285307 A1 Sep. 16, 2021

Related U.S. Application Data

(63) Continuation of application No. 16/176,852, filed on Oct. 31, 2018, now Pat. No. 11,047,210.

(51) Int. Cl.

| | |
|---|---|
| ***E21B 37/04*** | (2006.01) |
| ***E21B 23/01*** | (2006.01) |
| *E21B 7/06* | (2006.01) |
| *E21B 29/06* | (2006.01) |

(52) U.S. Cl.

CPC ..... *E21B 37/04* (2013.01); *E21B 23/01* (2013.01); *E21B 7/061* (2013.01); *E21B 29/06* (2013.01)

(58) Field of Classification Search

CPC ..... E21B 37/04; E21B 23/01; E21B 7/061; E21B 29/06

See application file for complete search history.

(56) References Cited

U.S. PATENT DOCUMENTS

| | | | | |
|---|---|---|---|---|
| 6,152,221 | A | 11/2000 | Carmichael et al. | |
| 6,896,064 | B2 | 5/2005 | Howlett et al. | |
| 7,048,055 | B2 | 5/2006 | Hirth | |
| 8,141,628 | B2 | 3/2012 | Hart | |
| 9,435,176 | B2 | 9/2016 | Bansal et al. | |
| 9,879,505 | B2 | 1/2018 | Holloway et al. | |
| 10,151,164 | B2 | 12/2018 | Bennett et al. | |
| 10,724,322 | B2 | 7/2020 | Taylor, Jr. et al. | |
| 2006/0207771 | A1 | 9/2006 | Rios et al. | |
| 2013/0168151 | A1 | 7/2013 | Grigor et al. | |
| 2013/0192818 | A1* | 8/2013 | Winn | E21B 37/02 166/173 |

(Continued)

OTHER PUBLICATIONS

European Office Action in related application EP 19773220.9 dated Apr. 19, 2022.

*Primary Examiner* — Taras P Bemko

(74) *Attorney, Agent, or Firm* — Cabello Hall Zinda, PLLC

(57) ABSTRACT

A method of positioning a bottom hole assembly in a wellbore includes lowering the bottom hole assembly into the wellbore. The bottom hole assembly has a whipstock, a downhole tool, and a cleaning tool having a cleaning element. The method also includes cleaning at least a portion of a wall of the wellbore using the cleaning tool, and activating the downhole tool to engage the cleaned portion of the wall.

22 Claims, 39 Drawing Sheets

(56) References Cited

U.S. PATENT DOCUMENTS

| | | | | |
|---|---|---|---|---|
| 2014/0150822 | A1 | 6/2014 | Osaland | |
| 2015/0027708 | A1 | 1/2015 | Honekamp | |
| 2015/0275605 | A1 | 10/2015 | Bennett et al. | |
| 2016/0138369 | A1 | 5/2016 | Tunget | |
| 2016/0305219 | A1* | 10/2016 | Holloway | E21B 23/06 |
| 2016/0312582 | A1* | 10/2016 | Ali | E21B 37/02 |
| 2018/0209233 | A1 | 7/2018 | Hulsewe | |
| 2019/0316435 | A1 | 10/2019 | Taylor, Jr. | |

* cited by examiner

BOTTOM HOLE ASSEMBLY WITH A CLEANING TOOL

CROSS-REFERENCE TO RELATED APPLICATIONS

This application is a Continuation of application Ser. No. 16/176,852, filed on Oct. 31, 2018, which application is incorporated herein by reference in its entirety.

BACKGROUND

Field

Embodiments of the present disclosure relate to a bottom hole assembly equipped with a cleaning tool. In particular, this disclosure relates to a downhole anchor equipped with a cleaning tool. More particularly still, this disclosure relates to a sidetrack assembly equipped with a cleaning tool.

Description of the Related Art

In recent years, technology has been developed which allows an operator to drill a primary vertical well, and then continue drilling an angled lateral borehole off of that vertical well at a chosen depth. Generally, the vertical, or "parent" wellbore is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

A lateral wellbore can be formed off of a parent wellbore. Forming lateral or "sidetrack" wellbore, a tool known as a whipstock is positioned in the parent wellbore at the depth where deflection is desired, typically at or above one or more producing zones. The whipstock is used to divert milling bits into a side of the parent wellbore to create a pilot borehole in the parent wellbore. Thereafter, a drill bit is run into the parent wellbore. The drill bit is deflected against the whipstock, and urged through the pilot borehole. From there, the drill bit contacts the rock formation in order to form the new lateral hole in a desired direction. This process is sometimes referred to as sidetrack drilling.

When forming the lateral wellbore through the parent wellbore, an anchor is first set in the parent wellbore at a desired depth. The anchor typically includes slips and seals. The anchor tool acts as a fixed body against which tools above it may be urged to activate different tool functions. The anchor tool typically has a key or other orientation-indicating member.

A whipstock is next run into the wellbore. The whipstock has a body that lands into or onto the anchor. A stinger is located at the bottom of the whipstock which engages the anchor device. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding wellbore for forming the pilot borehole.

In order to form the pilot borehole, a milling bit, or "mill," is placed at the end of a string of drill pipe or other working string. In some milling operations, a series of mills is run into the hole. First, a starting mill is run into the hole. Rotation of the string with the starting mill rotates the mill, causing a portion of the wellbore to be removed. This mill is followed by other mills, which complete the pilot borehole or extend the lateral wellbore.

In some instances, the casing wall of the parent wellbore has a contaminated surface that may affect the engagement of the anchor with the casing wall or the seal formed by the packer with the casing wall. For example, the contact surface of the wall can have a thin sheath of cement left behind from a cementing operation or a layer of drilling mud used to displace the cement. Other sources of contaminants include the cuttings from the formation, debris from drilling out the wiper plug and the remaining cement in the casing. In deviated or horizontal wells, any remaining cuttings may settle on the low side of the wellbore when the circulation is stopped. The cuttings may become embedded in the dehydrated solids on the casing wall.

There is a need, therefore, for a whipstock and anchor assembly to include a cleaning tool to clean the wall of the wellbore. There is also a need for a bottom hole assembly equipped with a cleaning tool to clean the wall of the wellbore in a single trip.

SUMMARY

In one embodiment, a method of positioning a bottom hole assembly in a wellbore includes lowering the bottom hole assembly into the wellbore, the bottom hole assembly having a downhole tool and a cleaning tool having a cleaning element. The method also includes cleaning at least a portion of a wall of the wellbore using the cleaning tool and activating the downhole tool to engage the cleaned portion of the wall.

In another embodiment, a bottom hole assembly for use in a wellbore includes a downhole tool; and a cleaning tool coupled to the downhole tool for cleaning a portion of a wall of the wellbore. In one example, the cleaning tool includes a body; and a plurality of cleaning elements for cleaning the portion of the wall, wherein the downhole tool is configured to engage the cleaned portion of the wall.

In another embodiment, a bottom hole assembly for use in a wellbore includes a whipstock; a downhole tool coupled to the whipstock; and a cleaning tool coupled to the downhole tool for cleaning a portion of a wall of the wellbore, wherein the downhole tool is configured to engage the cleaned portion of the wall. In one example, the cleaning tool includes a body and a plurality of cleaning elements for cleaning the portion of the wall.

In another embodiment, a method of positioning a bottom hole assembly in a wellbore includes lowering the bottom hole assembly into the wellbore, the bottom hole assembly having a whipstock, a downhole tool, and a cleaning tool having a cleaning element; cleaning at least a portion of a wall of the wellbore using the cleaning tool; and activating the downhole tool to engage the cleaned portion of the wall.

BRIEF DESCRIPTION OF THE DRAWINGS

So that the manner in which the above recited features of the present disclosure are attained and can be understood in detail, a more particular description of the disclosure, briefly summarized above, may be had by reference to the drawings that follow. The drawings illustrate only selected embodiments of this disclosure, and are not to be considered limiting of its scope.

DETAILED DESCRIPTION OF THE PREFERRED EMBODIMENT

Figure 1A:
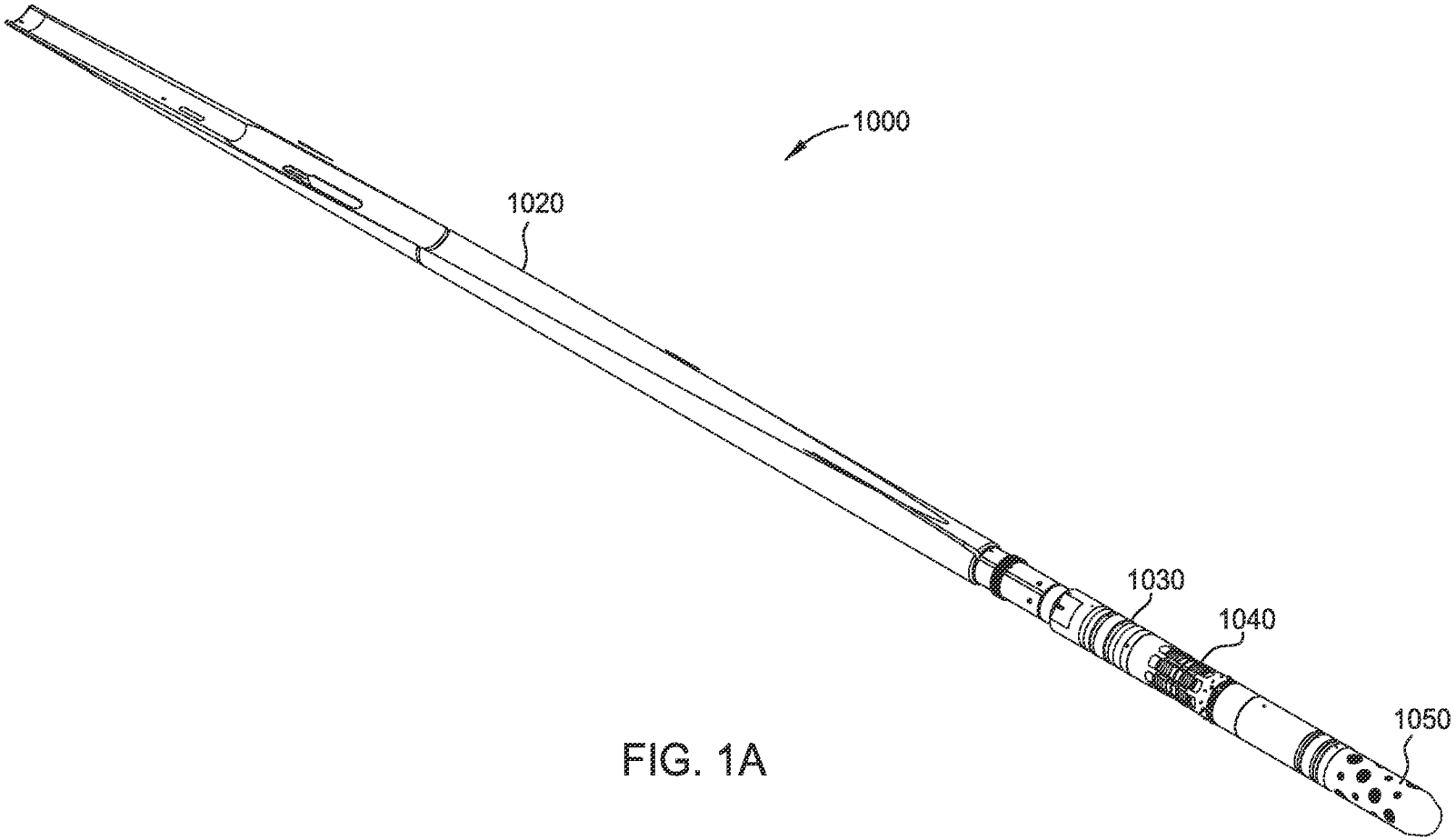
FIG. 1A illustrates an exemplary embodiment of a bottom hole assembly.
Figure 1B:
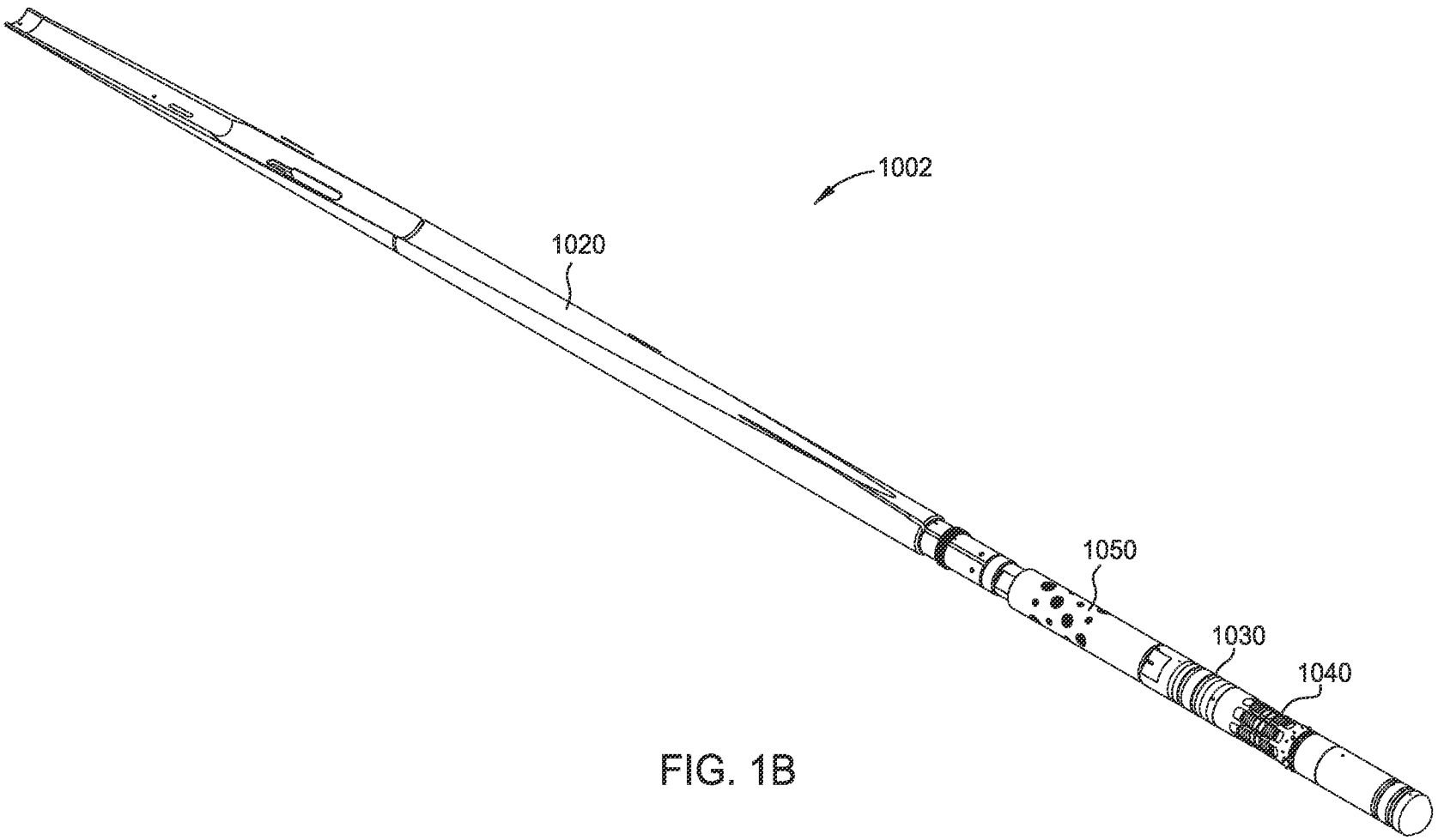
FIG. 1B illustrates another exemplary embodiment of a bottom hole assembly.

FIG. 1A illustrates an exemplary embodiment of a bottom hole assembly 1000. The BHA 1000 includes a whipstock 1020 coupled to one or more downhole tools. In one embodiment, the BHA 1000 includes downhole tools such as a packer 1030, an anchor 1040, and a cleaning tool 1050. The BHA 1000 may include an optional mill releasably attached to the whipstock 1020. The BHA with the cleaning tool 1050 can be run-in in a single trip. In one embodiment, the BHA 1000 can clean the wellbore, set the anchor, set the packer, and form a sidetrack in the wellbore in a single trip. It is contemplated the downhole tools can be arranged in any suitable order. As shown, the packer 1030, the anchor 1040, and the cleaning tool 1050 are sequentially attached below the whipstock 1020. In another embodiment, the BHA 1002 includes a cleaning tool 1050 attached below the whipstock 1020, and the packer 1030 and the anchor 1040 are sequentially attached below the cleaning tool 1050, as shown in FIG. 1B. In another embodiment, the BHA includes a cleaning tool attached to an anchor assembly, either with or without a packer. The whipstock can be connected to the anchor assembly in a separate trip.

Figure 1:
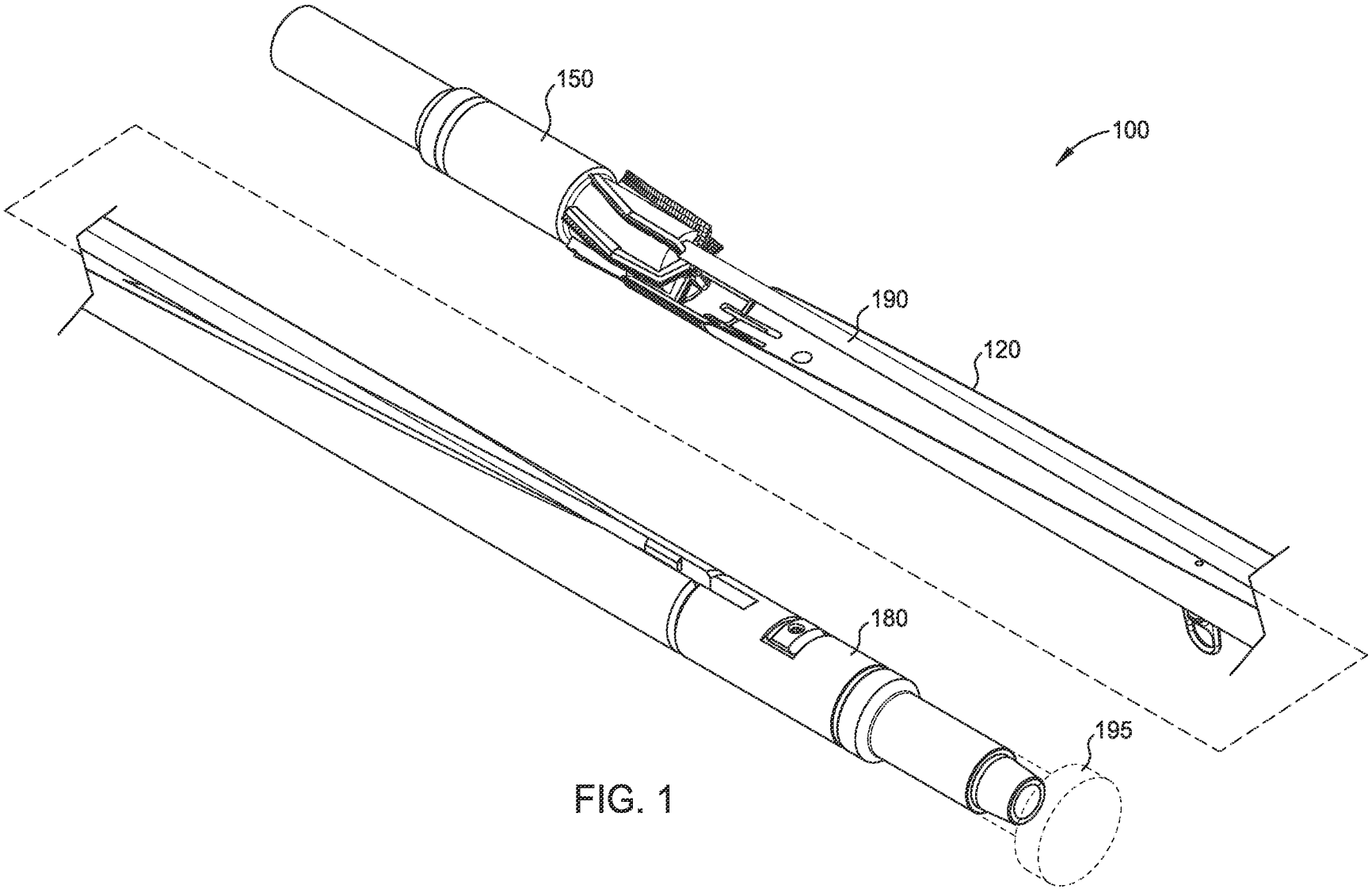
FIG. 1 is a perspective view of an exemplary embodiment of a sidetrack assembly.
Figure 2:
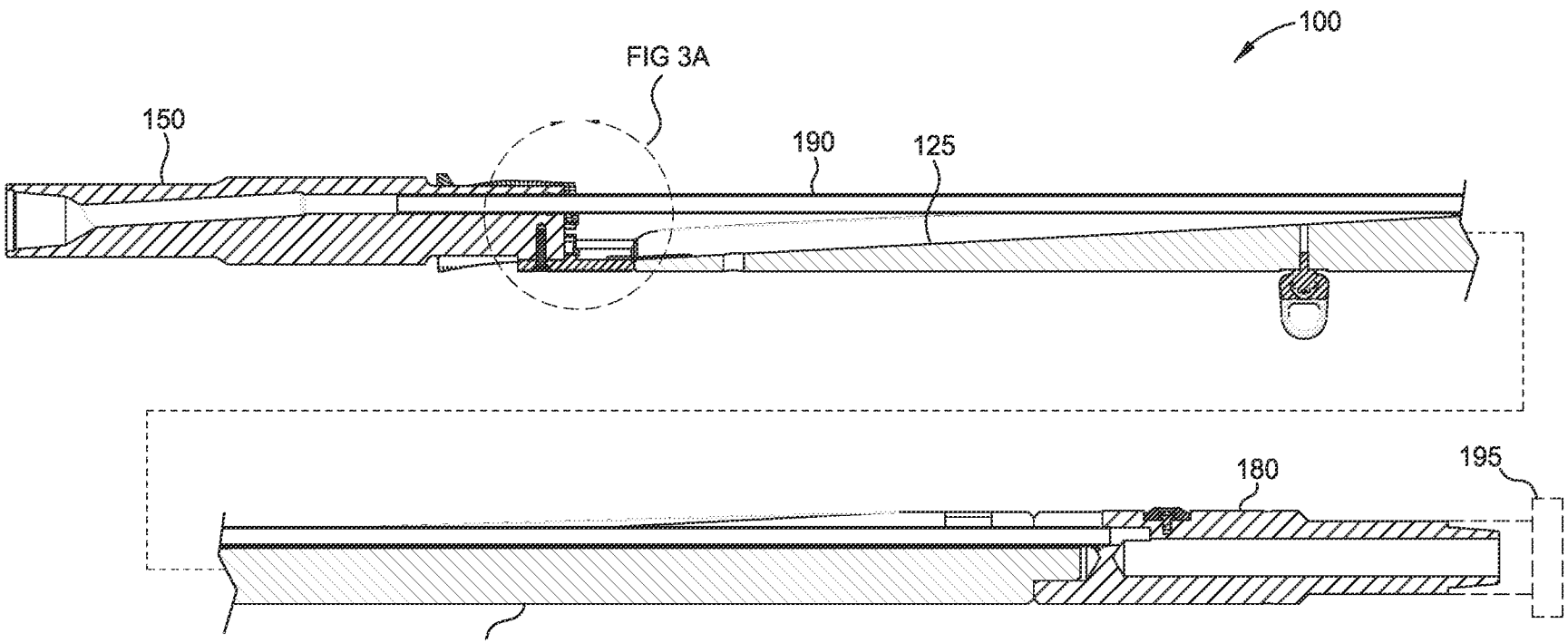
FIG. 2 is a cross-sectional view of the sidetrack assembly of FIG. 1.
Figure 3B:
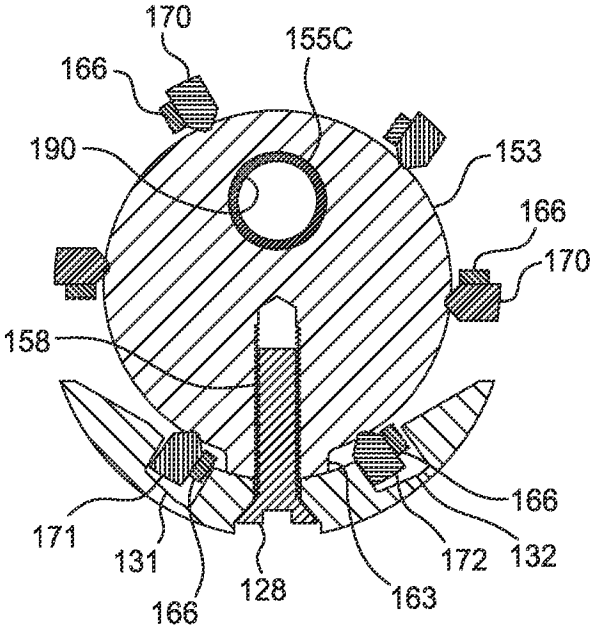
FIGS. 3A and 3B are enlarged partial cross-sectional views of the sidetrack assembly of FIG. 2.
Figure 3A:
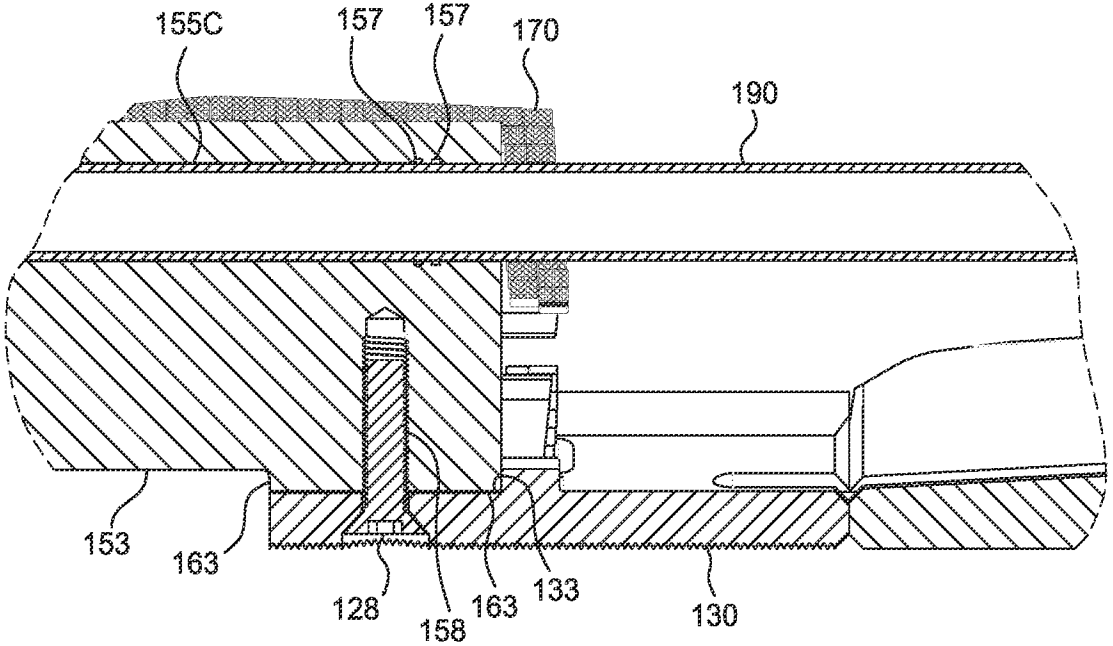

FIG. 1 is a perspective view of one embodiment of a sidetrack assembly 100 for forming at least a portion of a lateral wellbore in a parent wellbore. FIG. 2 is a cross-sectional view of the sidetrack assembly 100 of FIG. 1. FIGS. 3A and 3B are enlarged partial views of the sidetrack assembly 100 of FIG. 2. The sidetrack assembly 100 is suitable for use as a component of the BHA 1000 of FIG. 1A.

In this embodiment, the sidetrack assembly 100 includes a drilling assembly releasably attached to a whipstock 120. The drilling assembly may be a mill 150 or a drill bit. The mill 150 is attached to the upper end of the whipstock 120. The lower end of the whipstock 120 is attached to an adapter 180 for connection to one or more downhole tools 195, such as an anchor, a packer, a fishing tool, a cement basket, a cleaning tool, and combinations thereof. In another embodiment, the adapter 180 is integrated with the whipstock 120. In another embodiment, the adapter 180 is integrated with the downhole tool 195.

The whipstock 120 includes a concave, inclined surface 125 for guiding the path of the mill 150. In one embodiment, the concave surface 125 at the upper portion of the whipstock 120 is an inclined cut out, as shown in FIGS. 1 and 2. The inclined cut out may be achieved using a concave cut on a wall of the whipstock 120. The inclined cut out may begin at the upper end of the whipstock 120 and may extend toward the lower end. In one embodiment, the inclined cut out formed on the upper portion of the whipstock 120 is used as a concave ramp to guide the movement of the mill 150 and set the mill's angle of attack to form a portion of the lateral wellbore, e.g., to form the pilot borehole. In one embodiment, the inclined cut out is between about 2 degrees and 15 degrees; preferably between 2 degrees and 8 degrees; and more preferably between about 2 degrees and 5 degrees.

Figure 3C:
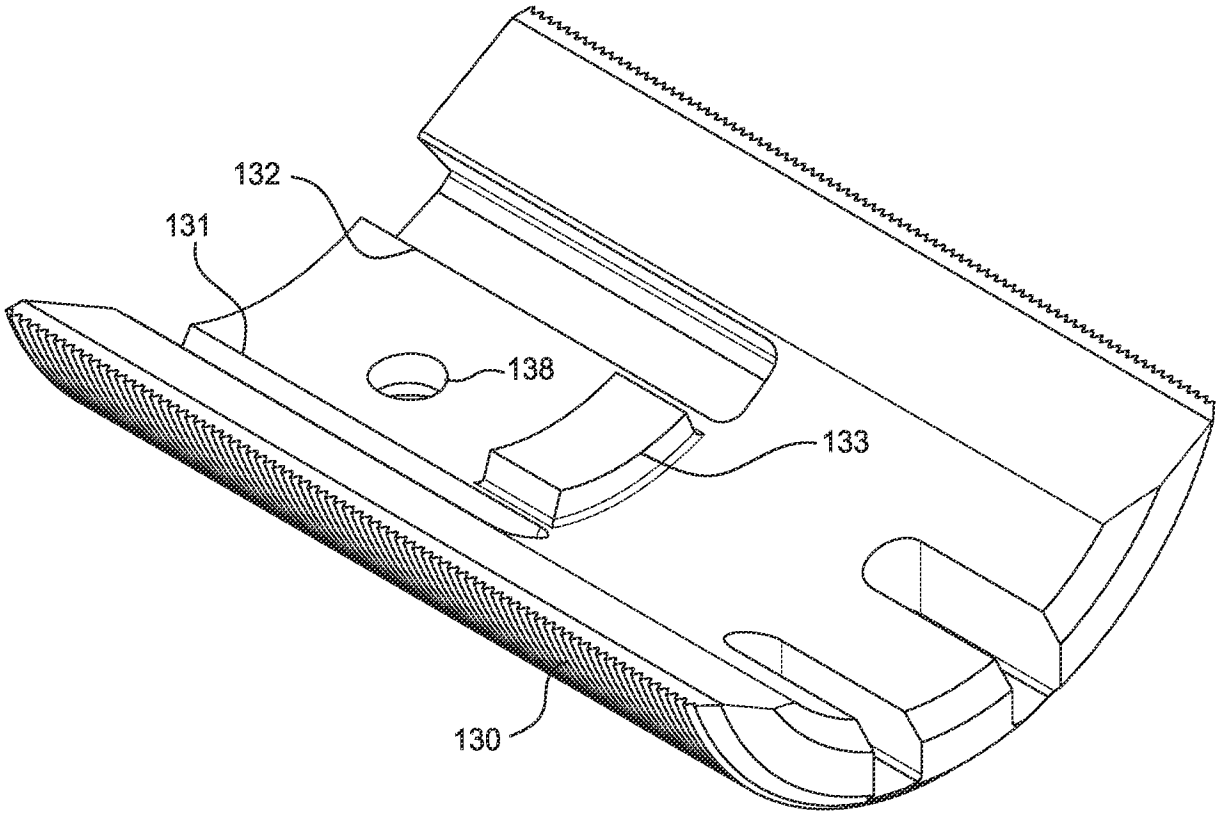
FIG. 3C is a perspective view of an embodiment of an attachment section of a whipstock in accordance with the present disclosure.

During run-in, the mill 150 is attached to the upper end of the whipstock 120 using a shearable member 128 such as a shear screw, as shown in FIG. 3A. The upper end of the whipstock 120 includes an attachment section 130 having flat or substantially flat upper surface. In one example, the upper surface of the attachment section 130 has an incline that is less than 1.5 degrees, less than 1 degree, or less than 0.5 degrees. In one embodiment, the attachment section 130 is attached to the whipstock 120, as shown in FIGS. 3A and 3C. In another embodiment, the attachment section 130 is integrated with the whipstock 120. For example, the attachment section 130 and the whipstock 120 are formed as a single unit. In some embodiments, the concave, inclined surface 125 of the whipstock 120 begins on at least a portion of the attachment section 130.

As shown in the perspective view of FIG. 3C, a lug 133 extends above a top surface of the attachment section 130. In another embodiment, a plurality of lugs is formed above the top surface of the attachment section 130. Two blade slots 131, 132 are formed in the attachment section 130 for receiving two blades of the mill 150. In another embodiment, the blade slots extend to a portion of the concave, inclined surface 125. In another embodiment, a single blade slot is used to receive a blade of the mill 150. A hole 138 is formed through the attachment section 130 to receive the shearable member 128. In this example, the hole 138 is located between the two blade slots 131, 132.

Figure 4A:
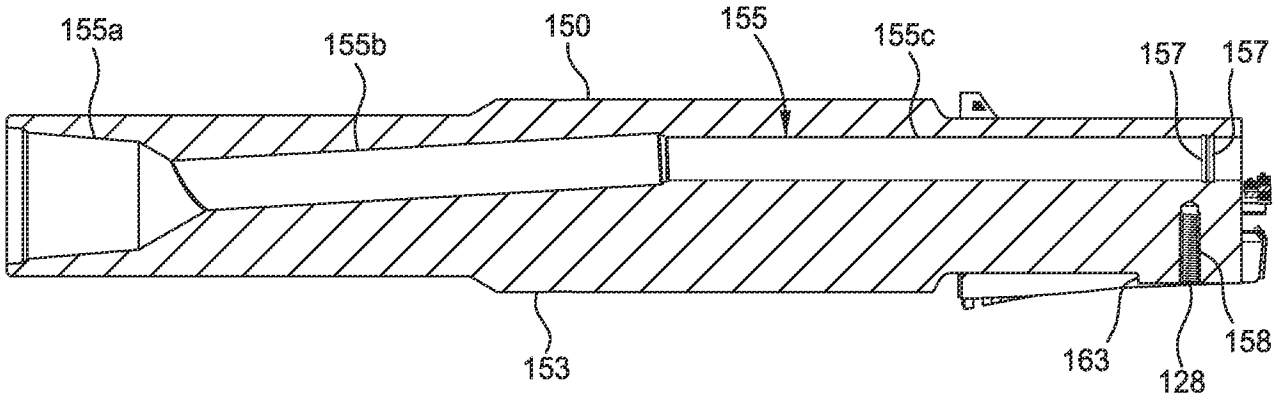
FIG. 4A is a front view of an exemplary mill of the sidetrack assembly in accordance with one embodiment.
Figure 4B:
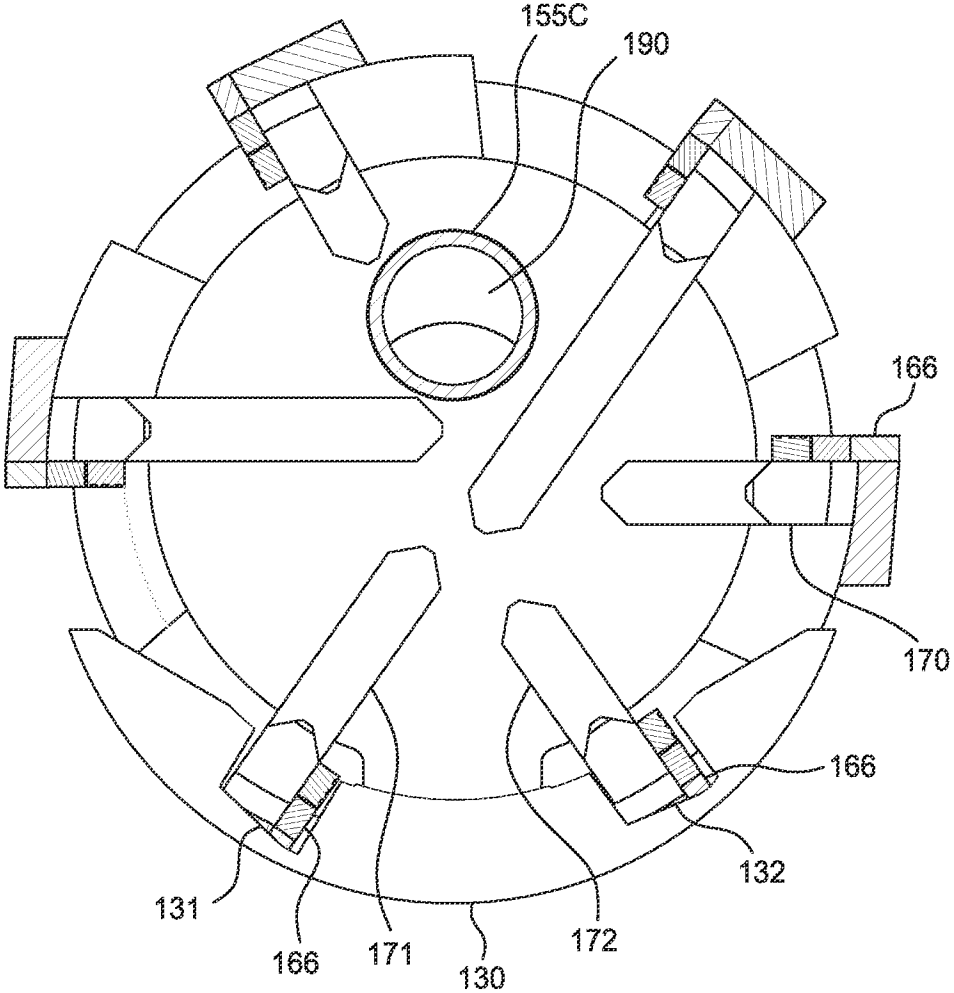
FIG. 4B is a cross-sectional view of the mill of FIG. 4A.

FIG. 4A is a cross-sectional view of the mill 150 of FIG. 2. FIG. 4B is a front view of the mill 150 of FIG. 2. The mill 150 includes a body 153 having a bore 155 extending therethrough. The bore 155 includes an inlet 155A, an angled passage 155B, and an offset passage 155C. The angled portion 155B fluidly connects the inlet 155A to the offset passage 155C. The central axis of the offset passage 155C is located above the central axis of the inlet 155A when the mill 150 is attached to the attachment section 130. The angled portion 155B may be angled between 1 degree and 8 degrees. In one example, the angled portion 155B has an inner diameter that is larger than the inner diameter of the offset passage 155C. One or more sealing members 157, such as o-rings, are disposed in the offset passage 155C near the outlet. In this embodiment, two sealing members 157 are provided. A slot 158 is formed on a bottom portion of the body 153 for engaging the shearable member 128. A lug 163 extends out of the bottom of the mill 150, as shown in FIGS. 3A and 3B. The lug 163 of the mill 150 is configured to engage the lug 133 of the attachment section 130. In one embodiment, the axial force can be transferred from one lug 133, 163 to the other lug 133, 163. For example, the mill 150 can apply a downward force on the whipstock 120 via the lugs 133, 163. The lugs 133, 163 allow the downward force applied to be greater than the force required to shear the shearable member 128. In one embodiment, a clearance exists between the shearable member 128 and the hole 138 in the whipstock 120 to reduce the amount of axial force transfer between the mill 150 and the whipstock 120. For example, the hole 138 is sized so that a minimal amount, such as less than 20%, of the downward force is transferred through the shearable member 128, while most of the downward force is transferred through the lugs 133, 163.

Figure 5:
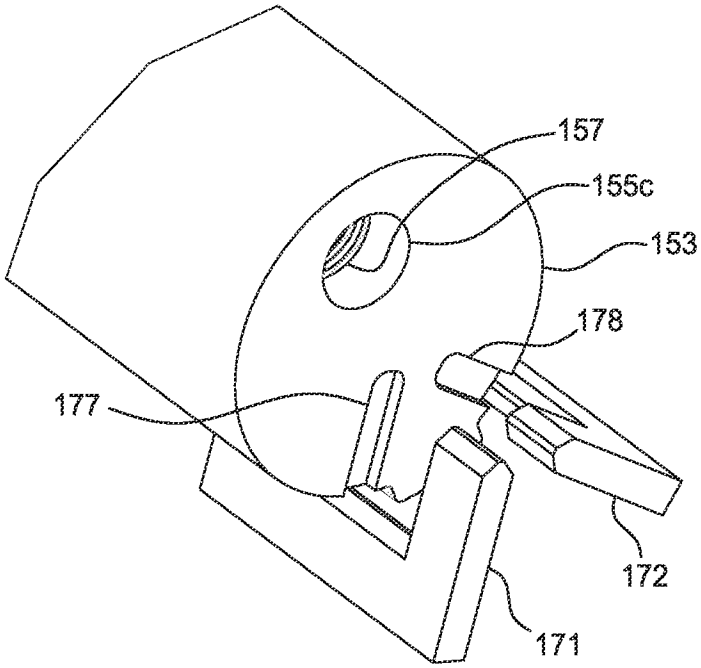
FIG. 5 is a perspective view an exemplary mill of the sidetrack assembly in accordance with the present disclosure.

The mill 150 is equipped with two or more blades 170, such as two, four, five, six, and eight blades. As shown in FIGS. 3B and 4B, the mill 150 includes six blades 170 arranged circumferentially on the mill 150. The blades 170 are disposed at various angles to accommodate position of the offset passage 155C. A plurality of cutting inserts 166 may be attached to a cutting surface of the blades 170. Two of the blades 171, 172 are disposed in the blades slots 131, 132 respectively, of the attachment section 130. While two blades are shown, it is contemplated that one or three blades are disposed in the blade slots of the whipstock 120. The blades 171, 172 in the slots 131, 132 can serve as torque keys to transfer torque from the mill 150 to the whipstock 120. As the mill 150 is rotated, the cutting inserts 166 of the blades 171, 172 will engage the sidewall of the slot 131, 132 to transfer torque to the whipstock 120. In one embodiment, the clearance between the blade 171 and the sidewall of the slot 131 is smaller than the clearance between the blade 172 and the sidewall of the slot 132. In this respect, when rotated, the blade 171 will engage the sidewall of the slot 131 before the blade 172 will engage the sidewall of the slot 132. In one embodiment, a clearance exists between the shearable member 128 and the hole 138 in the attachment section 130 to reduce the amount of torque transfer. For example, the hole 138 is sized such that a minimal amount, such as less than 20%, of the applied torque is transferred through the shearable member 128. In one embodiment, to facilitate the positioning of the blades 171, 172 in the respective slots 131, 132, grooves 177, 178 are formed in the mill body 150 for receiving the blades 171, 172 as shown in FIG. 5. The grooves 177, 178 facilitate proper attachment of the blades 171, 172 to the mill 150, which ensures the blades 171, 172 align with the slots 131, 132 during assembly. In one embodiment, the blades 171, 172 are in direct contact with the slots 131, 132. In another embodiment, an intermediate structure, such as a liner, is disposed in the slots 131, 132 and in contact with the blades 171, 172. The intermediate structure may be used to control the clearance between the blades and the slots.

In one embodiment, the sidetrack assembly 100 includes a flow path for supplying cement from the mill 150 to the wellbore below the whipstock 120. Referring to FIGS. 1 and 2, a tubing 190 is disposed in the whipstock 120. The lower end of the tubing 190 extends out of the whipstock 120 and is connectable with the adapter 180. The tubing 190 fluid communicates with the central passage of the adapter 180. The adapter 180 may be attached to a downhole tool 195, thereby placing the tubing 190 in fluid communication with the downhole tool 195. In one embodiment, the downhole tool is packer, anchor, or a combination of packer and anchor assembly. For example, the anchor may include a plurality of slips disposed on a mandrel having a bore. The packer may include a sealing element disposed on a mandrel having a bore. An exemplary packer is an inflatable packer.

Figure 2A:
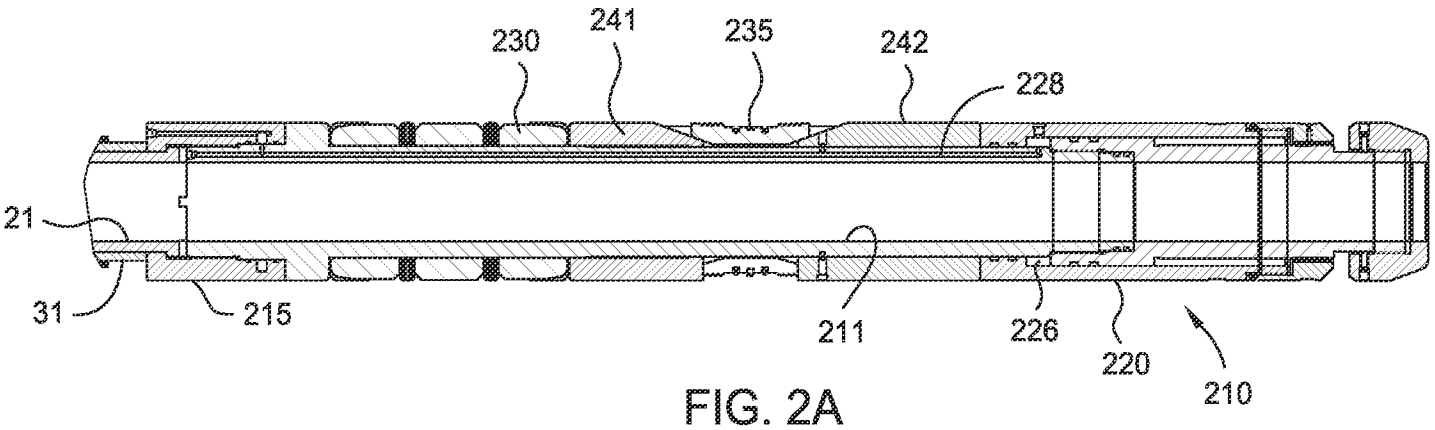
FIG. 2A is a cross-sectional view of an exemplary embodiment of a packer and anchor assembly.

FIG. 2A illustrates an exemplary embodiment of a packer and anchor assembly 210. The packer and anchor assembly 210 is suitable for use as the packer 1030 and the anchor 1040 of FIG. 1A. The packer and anchor assembly 210 is also suitable for use as the downhole tool 195 attached to the whipstock 120 shown in FIG. 1. The assembly 210 includes a mandrel 211, a locking sleeve 215, an actuating sleeve 220, a sealing element 230, a plurality of slips 235, and wedge members 241, 242. The locking sleeve 215 is configured to attach the whipstock 120 to the assembly 210. In one embodiment, the locking sleeve 215 has inwardly facing shoulders for engaging the shoulders at an end of the whipstock. The locking sleeve 215 may be threadedly connected to the mandrel 211. The upper end of the mandrel 211 may include one or more lug keys for engaging the lug slots of the whipstock 120 to prevent relative rotation therebetween. In another embodiment, the whipstock 120 is threadedly connected to the packer and anchor assembly 210 without using a locking sleeve 215.

The actuating sleeve 220, the sealing element 230, the plurality of slips 235, and the wedge members 241, 242 are disposed on the outer surface of the mandrel 211. The sealing member 230 is positioned between a shoulder of the mandrel 211 and an upper wedge member 241. The slips 235 are disposed between the upper wedge member 241 and the lower wedge member 242. The actuating sleeve 220 is disposed below the lower wedge member 242. An annular chamber 226 is defined between the actuating sleeve 220 and the mandrel 211. One or more seal rings may be used to seal the annular chamber 226. A hydraulic channel 228 through the mandrel 211 may be used to supply hydraulic fluid to the chamber 226. It is contemplated embodiments of the whipstock 120 may be used with any suitable packer, anchor, or a combination of packer and anchor assembly. For example, the anchor may include a plurality of slips disposed on a mandrel having a bore. The packer may include a sealing element disposed on a mandrel having a bore.

Referring to FIG. 3A, the upper end of the tubing 190 extends out of the whipstock 120 and is connectable with the offset passage 155C of the mill 150. During installation, the upper end of the tubing 190 is inserted into the offset passage 155C. The sealing members 157 engage the tubing 190 to prevent leakage. In one embodiment, the section of the tubing 190 inserted into the offset passage 155C is from 2 in. to 36 in., from about 3 in. to 24 in., or from about 6 in. to 18 in.

During assembly, the mill 150 is releasably attached to the whipstock 120. The tubing 190 is inserted into the offset passage 155C, and the blades 171, 172 are positioned in slots 131, 132, respectively, of the attachment section 130. The shearable screw 128 is inserted through the hole 138 of the attachment section 130 and the slot 158 of the mill 150 to releasably attach the mill 150 to the whipstock 120. In this example, the lug 163 of the mill 150 is engaged with the lug 133 of the attachment section 130. In this respect, axial force may be transmitted from the mill 150 to the whipstock 120.

Figure 6A:
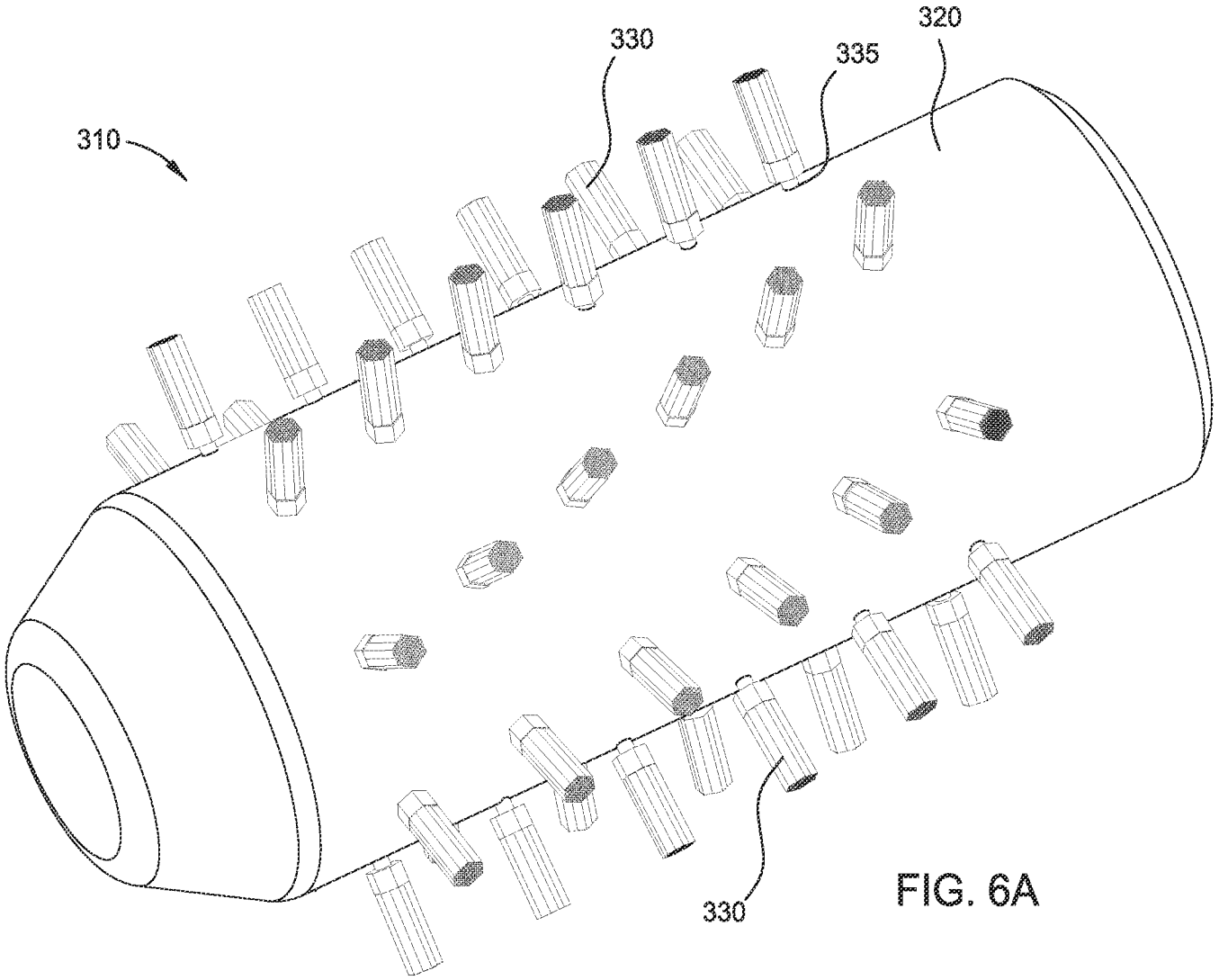
FIG. 6A is a perspective view of an exemplary embodiment of a cleaning tool.
Figure 6B:
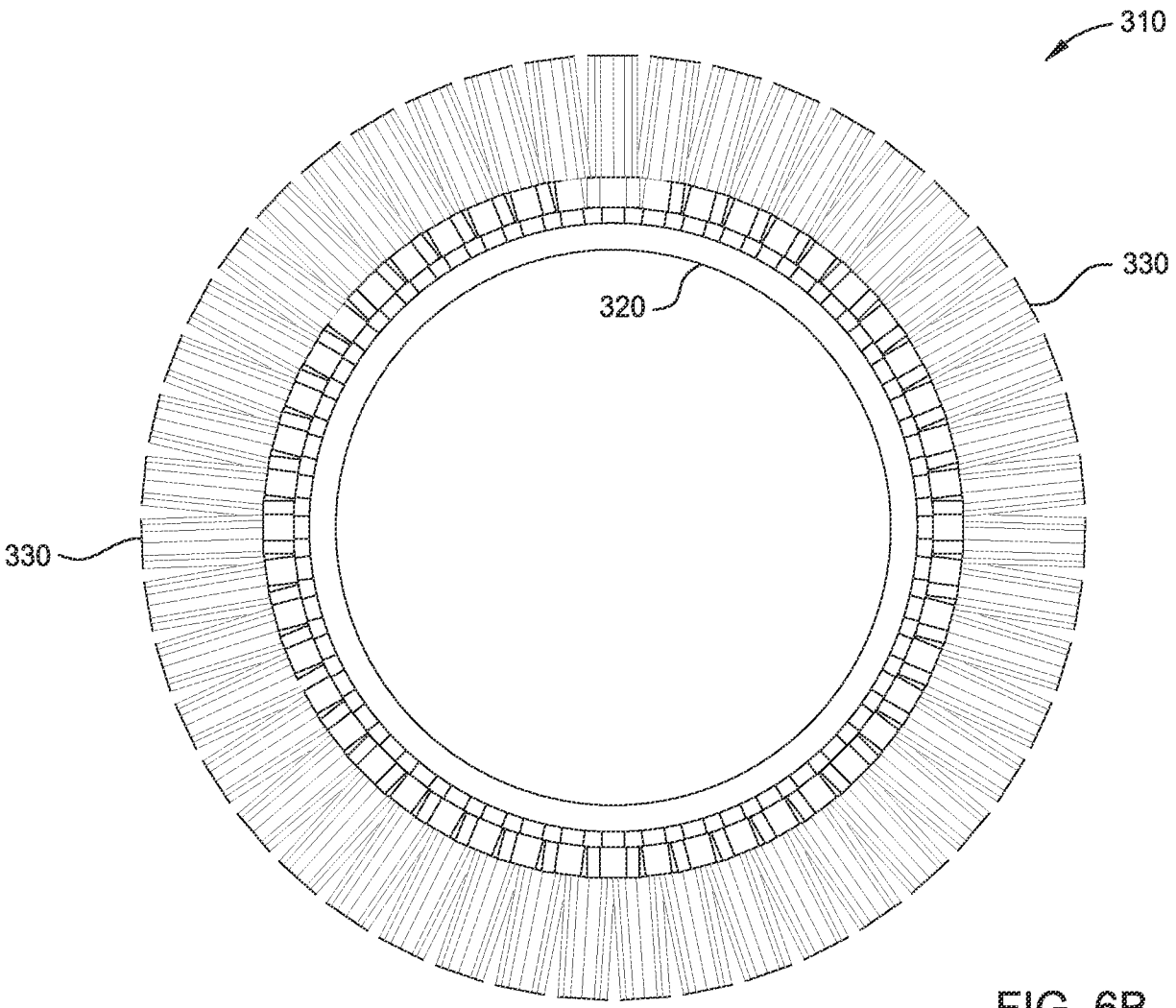
FIG. 6B is a top view of the cleaning tool of FIG. 6A.
Figure 6C:
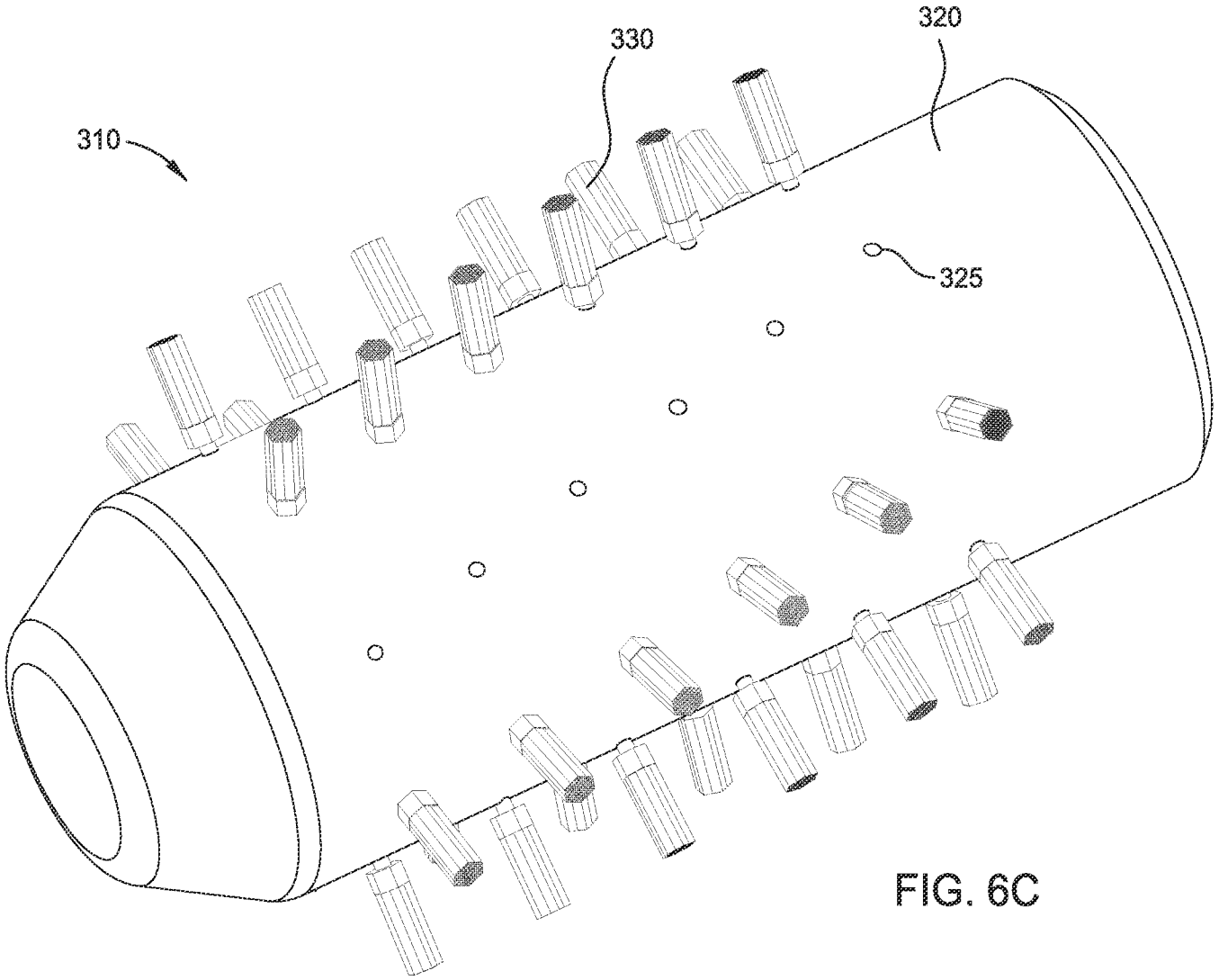
FIG. 6C is a perspective view of the cleaning tool of FIG. 6A.

FIGS. 6A-6C illustrate an exemplary embodiment of a cleaning tool 310. FIG. 6A is a perspective view of the cleaning tool 310. The cleaning tool 310 may be used as the cleaning tool 1050 in the BHA 1000 as shown in FIG. 1A. The cleaning tool 310 includes a body 320 and a plurality of cleaning elements 330. The body 320 is configured to attach to a BHA, such as using a threaded connection. The body 320 may be a cylindrical body having an optional bore. In another embodiment, the body 320 is integrated with the BHA.

In one embodiment, the cleaning elements 330 are bristles that can be attached to the body 310. For example, the bristles 330 are disposed on a screw cap 335, which can be screwed into holes 325 formed in the body 310. FIG. 6C is a perspective view of the cleaning tool 310 with some of the bristles 330 removed from the holes 325. FIG. 6B is a top view of the cleaning tool 310. The height of the bristles can be adjusted by controlling the depth of the screw cap 335 in the holes 325. As shown, the bristles 330 are arranged at the about the same height. However, it is contemplated the bristles 330 may be set at different heights. For example, some bristles 330 are set at a first height, and some bristles are set at a second height. In one example, the bristles are made of wires. In another example, the cleaning elements are scrapers having a flat edge.

The plurality of cleaning elements can be arranged on the body 320 in any suitable arrangement. As shown, the cleaning elements are arranged circumferentially in a row around the body. A plurality of rows is arranged vertically along the body, and each row is rotated slightly relative to an adjacent row. The cleaning elements are spaced sufficiently from each other to minimize clogging between bristles while cleaning debris. Other suitable arrangements include a diamond grid pattern and a square grid pattern.

In operation, the cleaning tool 310 is attached to the lower end of an exemplary BHA. The BHA may include the packer and anchor assembly 210, a whipstock 120, and a mill 150 releasably attached to the whipstock 120. After reaching the desire location, the BHA and the cleaning tool 310 are moved up and down relative to the wellbore to clean at least a portion of the wall of the wellbore. Optionally, the BHA and the cleaning tool 310 are rotated relative to the wellbore while cleaning. In some embodiments, fluid is circulated in the wellbore while operating the cleaning tool. After cleaning the wall, the packer and anchor assembly 210 is set. Hydraulic fluid can be supplied via the tubing 190 to set the anchor. For example, hydraulic is supplied to the chamber 226 to urge the actuating sleeve 220 upward, thereby moving the lower wedge member 242 closer to the upper wedge member 241. As a result, the slips 235 are urged up the inclined of the wedge members and outwardly into engagement with the surround casing. The slips 235 are set in the cleaned portion of the wellbore wall. After setting the slips 235, weight is set down on the whipstock 120, thereby compressing the sealing element 230 between the shoulder of the mandrel 211 and the upper wedge member 241. The sealing element 230 is urged outwardly into engagement with the surrounding casing to seal off fluid communication through the annulus. The sealing element 230 optionally engages the cleaned portion of the wellbore wall.

Additional pressure is applied to the mill 150 to release the mill 150 from the whipstock 120. For example, sufficient pressure is applied from the surface to break the shearable lug or screw 128 connecting the mill 150 to the whipstock 120. The mill 150 is then urged along the concave member of the whipstock 120, which deflects the mill 150 outward into engagement with the casing.

In one embodiment, the whipstock 120 is oriented to the desired azimuth after cleaning the wellbore and before setting the anchor. For example, the cleaning tool 310 is reciprocated to clean the wellbore. The cleaning tool 310 can optionally be rotated during cleaning. After cleaning, the whipstock 120 can be oriented using a Measurement-While-Drilling (MWD) unit coupled to or integral with the BHA. The anchor is then set in a cleaned portion of the wellbore.

In another embodiment, the whipstock 120 is oriented before cleaning the wellbore. For example, the whipstock 120 can be oriented using a Measurement-While-Drilling (MWD) unit coupled to or integral with the BHA. After orienting the whipstock, the cleaning tool 310 is reciprocated to clean the wellbore. In one example, the cleaning tool is not rotated during cleaning. After cleaning, the anchor is set in a cleaned portion of the wellbore.

Figure 7A:
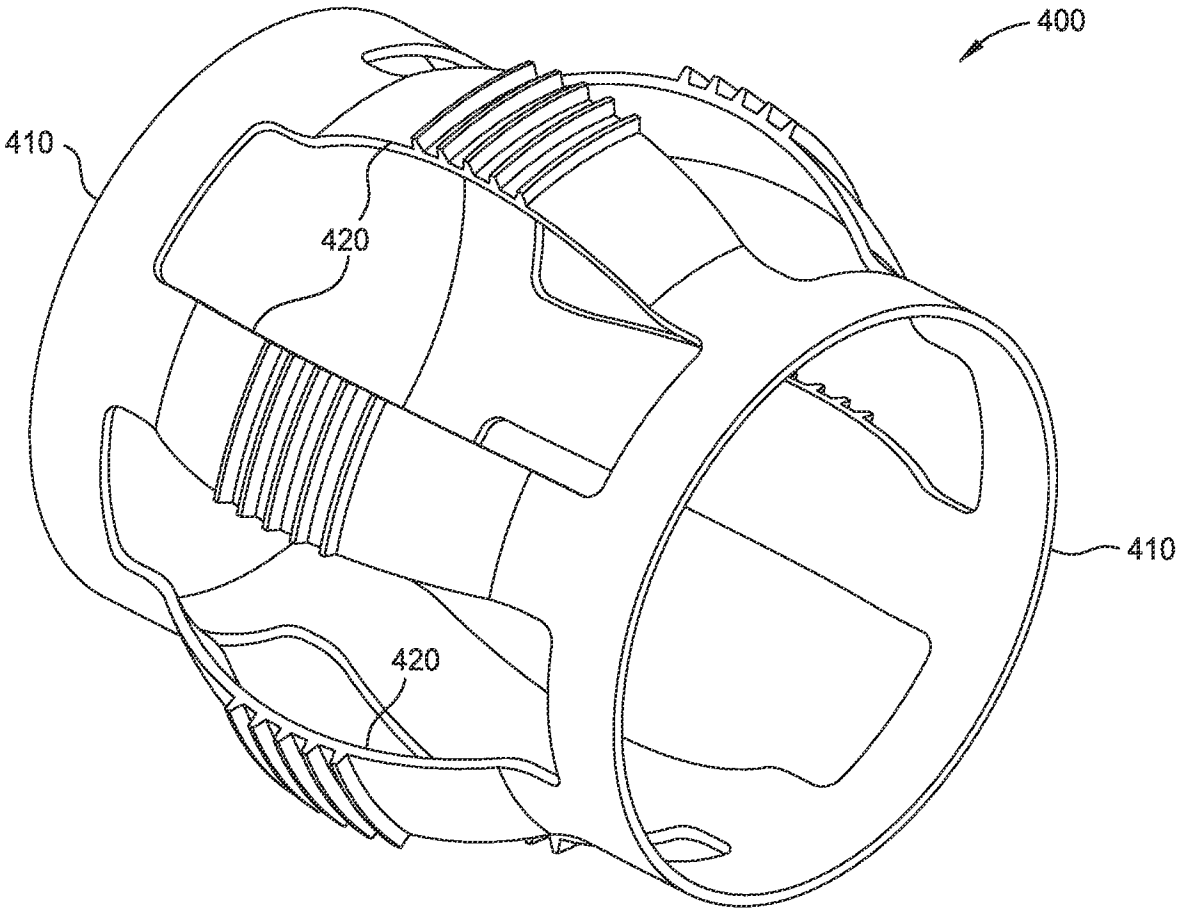
FIG. 7A is a perspective view of another embodiment of a cleaning tool.
Figure 7B:
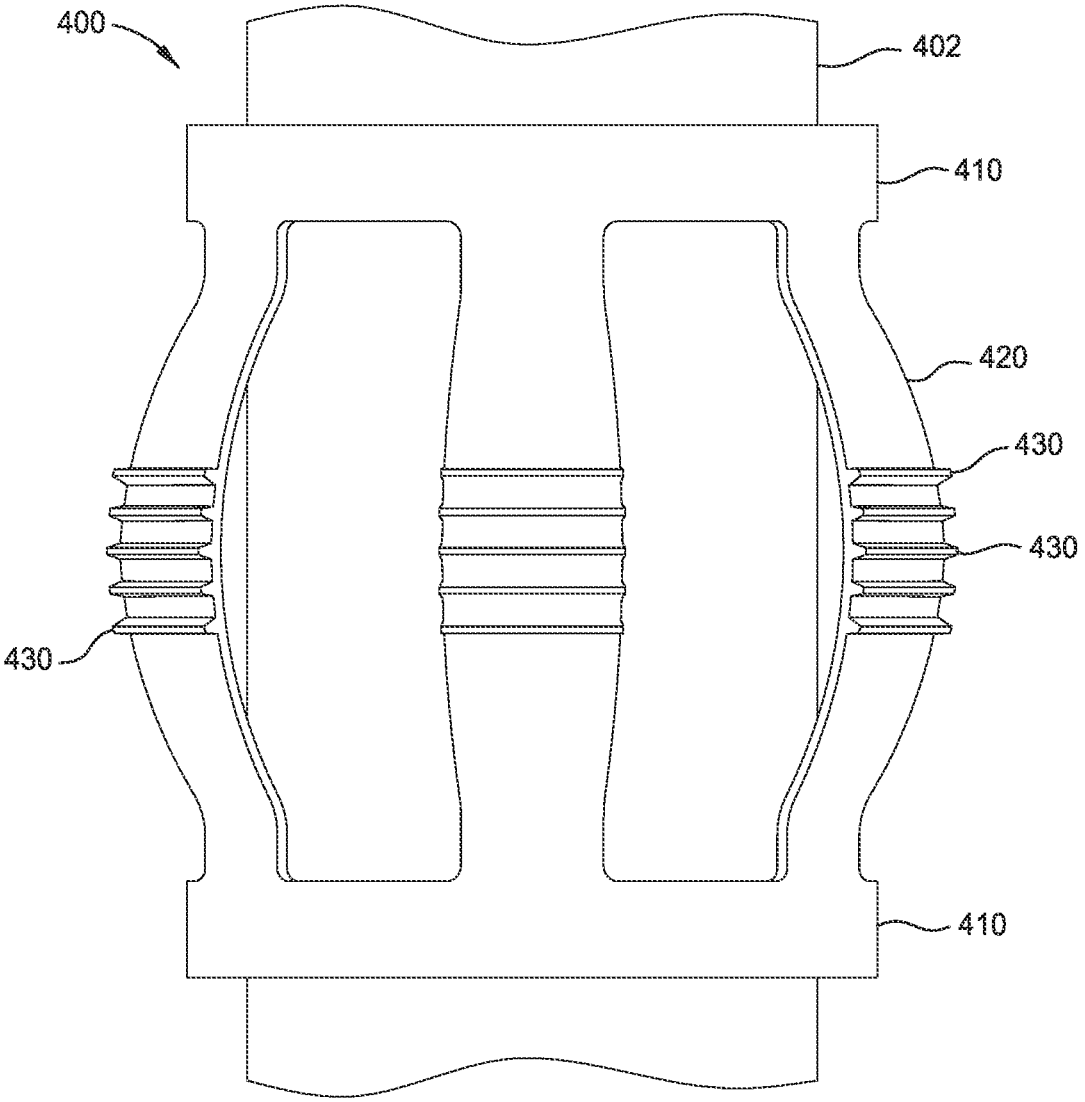
FIG. 7B is a front view of the cleaning tool of FIG. 7A.
Figure 7C:
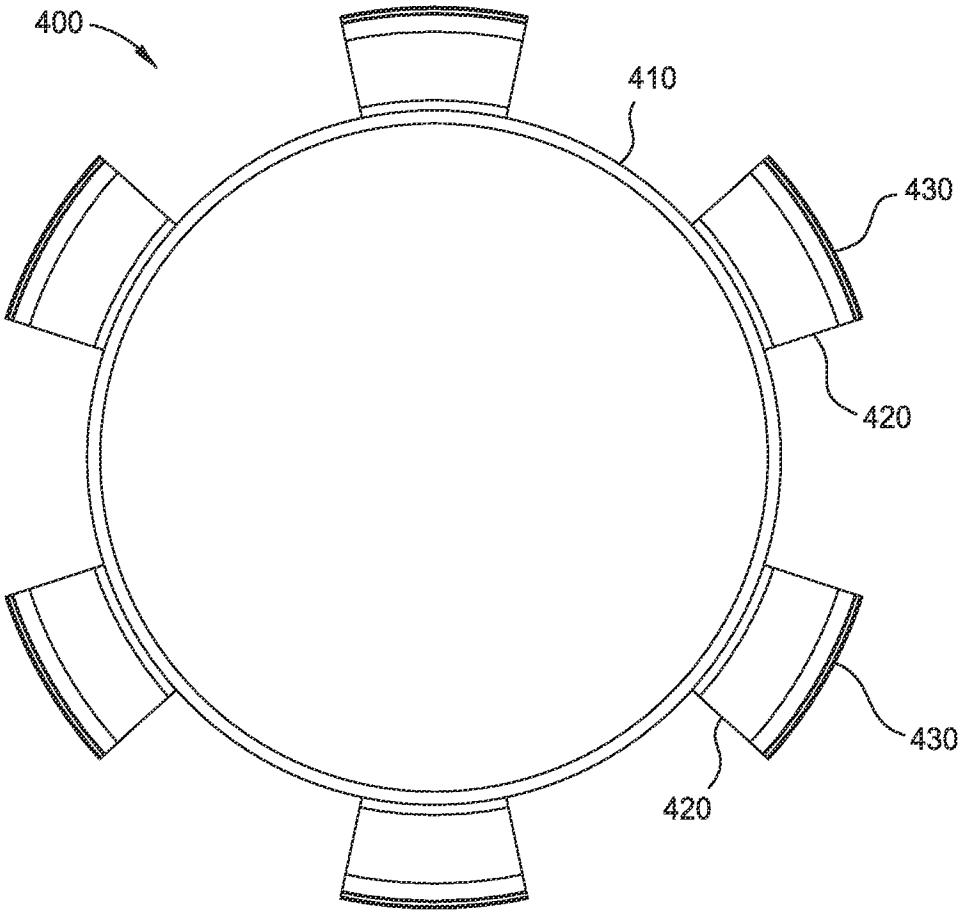
FIG. 7C is a top view of the cleaning tool of FIG. 7A.

FIGS. 7A-C illustrate another embodiment of a cleaning tool 400 suitable for use with a BHA. The cleaning tool 400 may be used as the cleaning tool 1050 shown in FIG. 1A. FIG. 7A is a perspective view of the cleaning tool 400. FIG. 7B is a front view of the cleaning tool 400. FIG. 7C is a top view of the cleaning tool 400. The cleaning tool 400 is a centralizer having a plurality of bow springs 420 connected between two collars 410. The bow springs 420 are circumferentially spaced around the collars 410. In one embodiment, the collars 410 of the cleaning tool 400 are disposed around a tubular body 402 (as shown in FIG. 7B), and the tubular body is attached to the BHA. In another embodiment, the collars 410 are disposed around a tubular body of the BHA.

A plurality of cleaning elements is disposed on an exterior surface of the bow springs 420. In this example, the cleaning elements are scrapers 430 having a raised edge. As shown, the scrapers 430 are aligned horizontally relative to the bow spring 420. While five scrapers are shown, any suitable number of scrapers may be used, such as one, two, three, four, six, eight, ten, or more scrapers. In another example, the scrapers are aligned at an angle relative to the bow springs. In another example, the scrapers on one bow spring are aligned at a different angle than the scrapers on another bow spring. In another embodiment, the scrapers have different heights on the same or different bow springs. For example, some scrapers are set at a first height, and some scrapers are set at a second height.

In operation, the cleaning tool 400 is disposed around a tubular body 402 that is attached to the lower end of a BHA. The BHA may include the packer and anchor assembly 210, a whipstock 120, and a mill 150 releasably attached to the whipstock 120. In one embodiment, the cleaning tool 310 of FIG. 6A is also connected to the BHA. After reaching the desire location, the BHA and the cleaning tool 400 are moved up and down relative to the wellbore to clean the wall of the wellbore. Because gaps exist between the bow springs 420, the BHA and the cleaning tool 400 are optionally rotated relative to the wellbore such that the bow springs can clean the gaps from the previous position of the bow springs. After rotation, the cleaning tool 400 is reciprocated relative to the wellbore to clean the wall of the wellbore. In another embodiment, engagement with the wellbore wall may cause the bow springs 420 to rotate relative to the body 402, thereby cleaning at least a portion of the gaps. In some embodiments, fluid is circulated in the wellbore while operating the cleaning tool. After cleaning the wall, the packer and anchor assembly 210 is set. Optionally, the whipstock 120 is oriented either after or before cleaning the wellbore as described above. Hydraulic fluid can be supplied via the tubing 190 to set the anchor. The slips 235 are set in the cleaned portion of the wellbore wall. Compressive force is then applied to set the packer. To release the mill 150, additional compressive force is applied to shear the shearable member 128. The mill 150 is now free to move along the whipstock 120 to form a window in the wellbore.

Figure 8A:
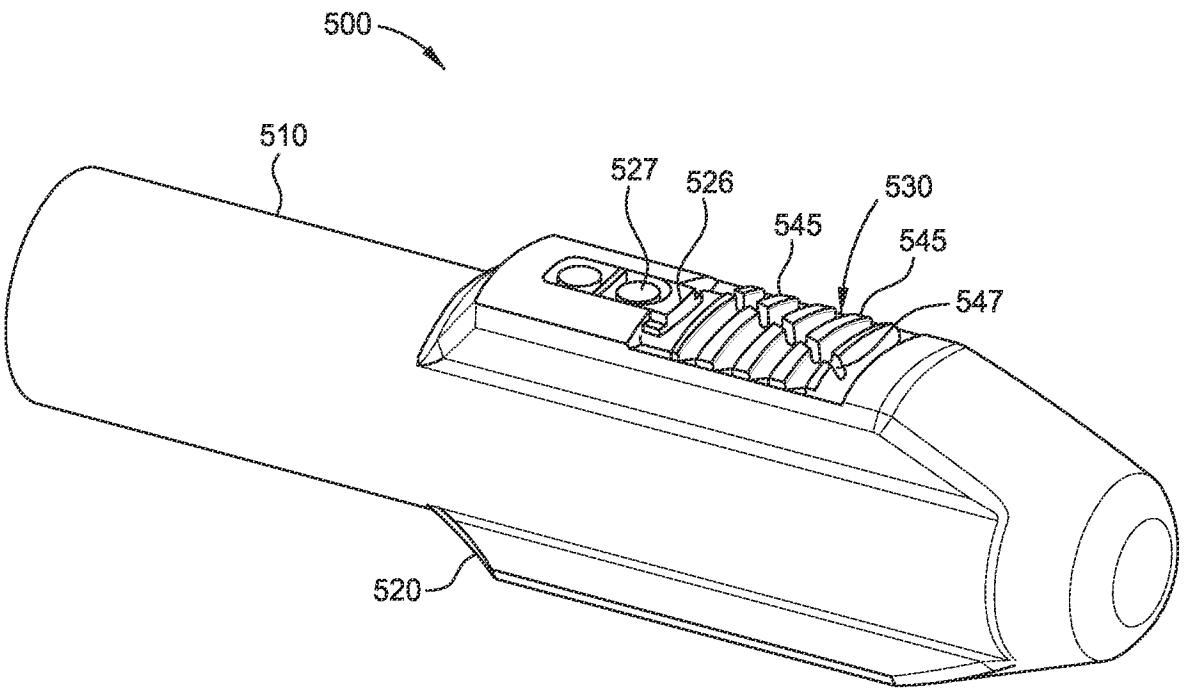
FIG. 8A is a perspective view of another embodiment of a cleaning tool.
Figure 8B:
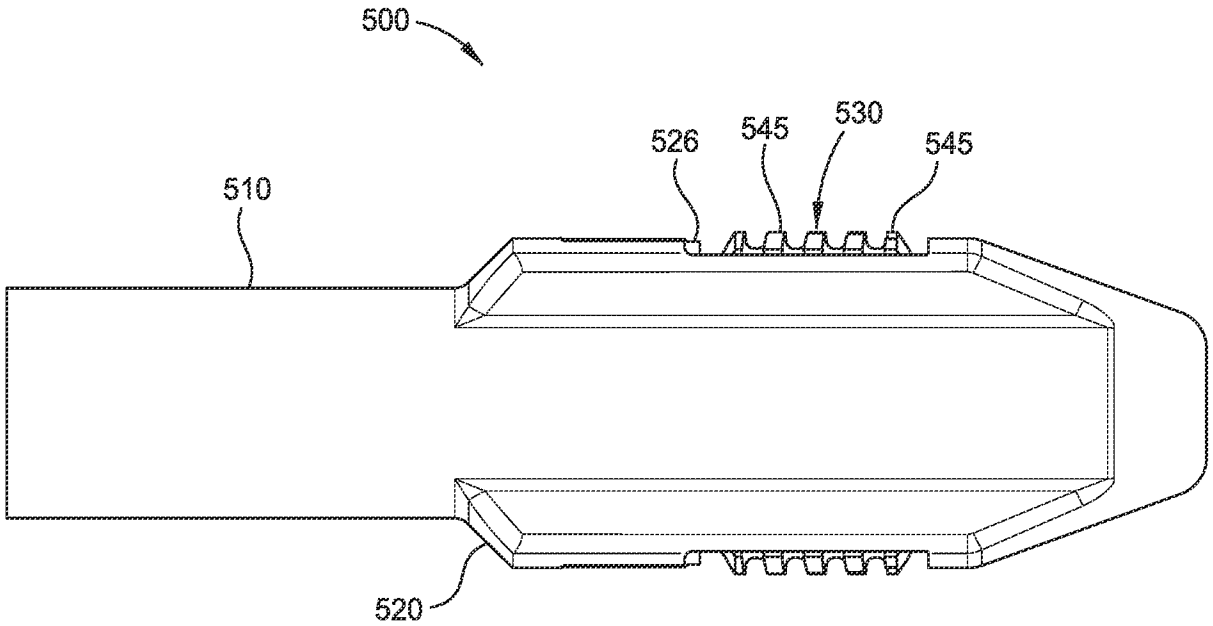
FIG. 8B is a front view of the cleaning tool of FIG. 8A.
Figure 8C:
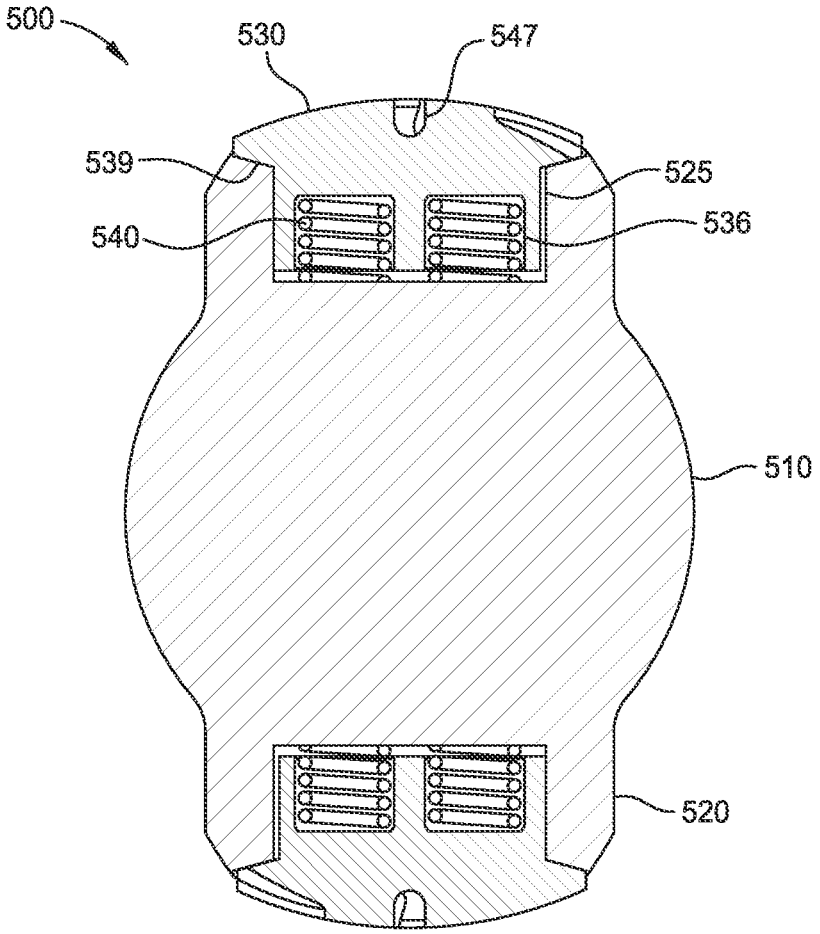
FIG. 8C is a cross-sectional view of the cleaning tool of FIG. 8A.

FIGS. 8A-C illustrate another embodiment of a cleaning tool 500 suitable for use with a BHA. The cleaning tool 500 may be used as the cleaning tool 1050 shown in FIG. 1A. FIG. 8A is a perspective view of the cleaning tool 500. FIG. 8B is a front view of the cleaning tool 500. FIG. 8C is a cross-sectional view of the cleaning tool 500. The cleaning tool 500 includes a body 510 and a plurality of cleaning elements 530 at least partially disposed in the body 510. In one embodiment, the body 510 is a cylindrical body having a plurality of raised profiles 520 for housing the cleaning elements 530. In this example, the cleaning elements 530 are disposed in a pocket 525 formed in the raised profiles 520. The raised profiles 520 are arranged on opposite sides of the body 510. Although two raised profiles 520 are shown, the cleaning tool 500 may have any suitable number of profiles 520 for housing the cleaning elements. In another embodiment, the body 510 is a tubular body having a bore.

Figure 8D:
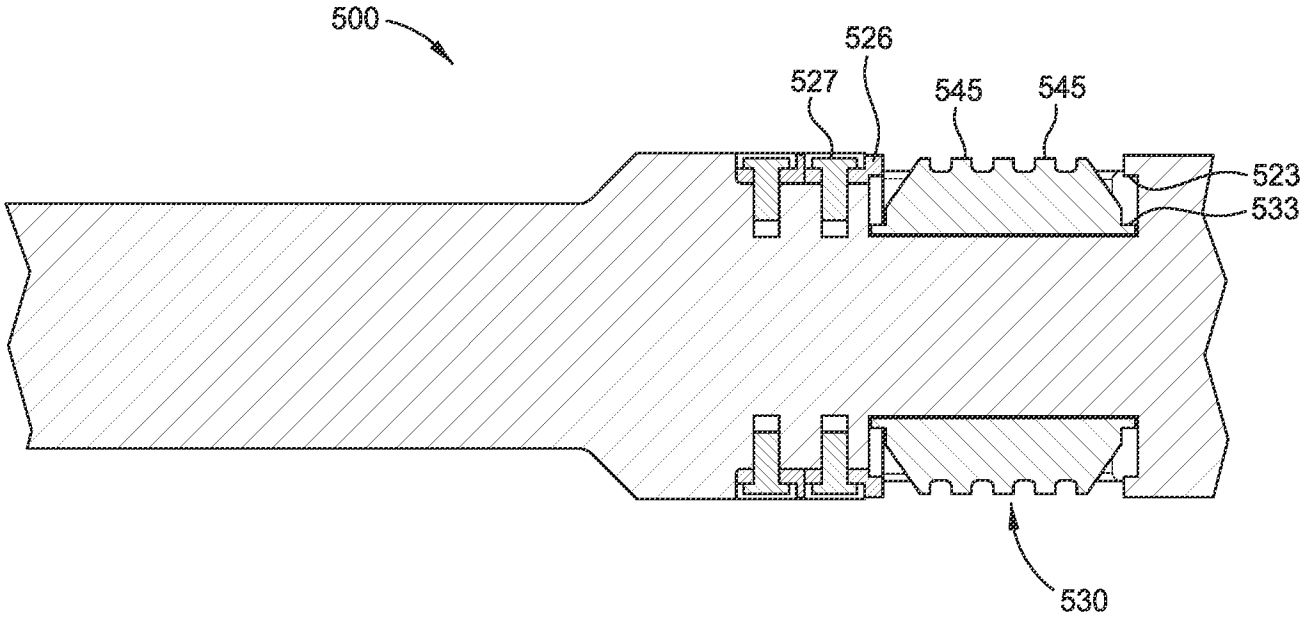
FIG. 8D is an enlarged, partial, front cross-sectional view of the cleaning tool of FIG. 8A.
Figure 9A:
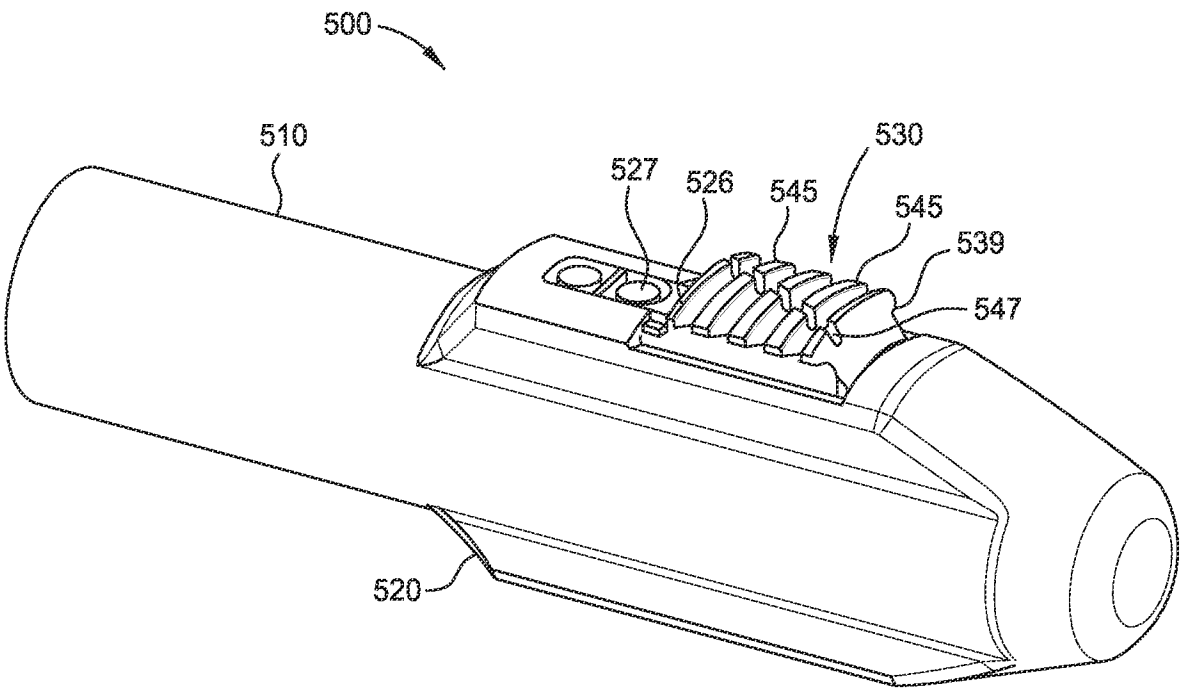
FIG. 9A is a perspective view of the cleaning tool of FIG. 8A in an activated position.
Figure 9B:
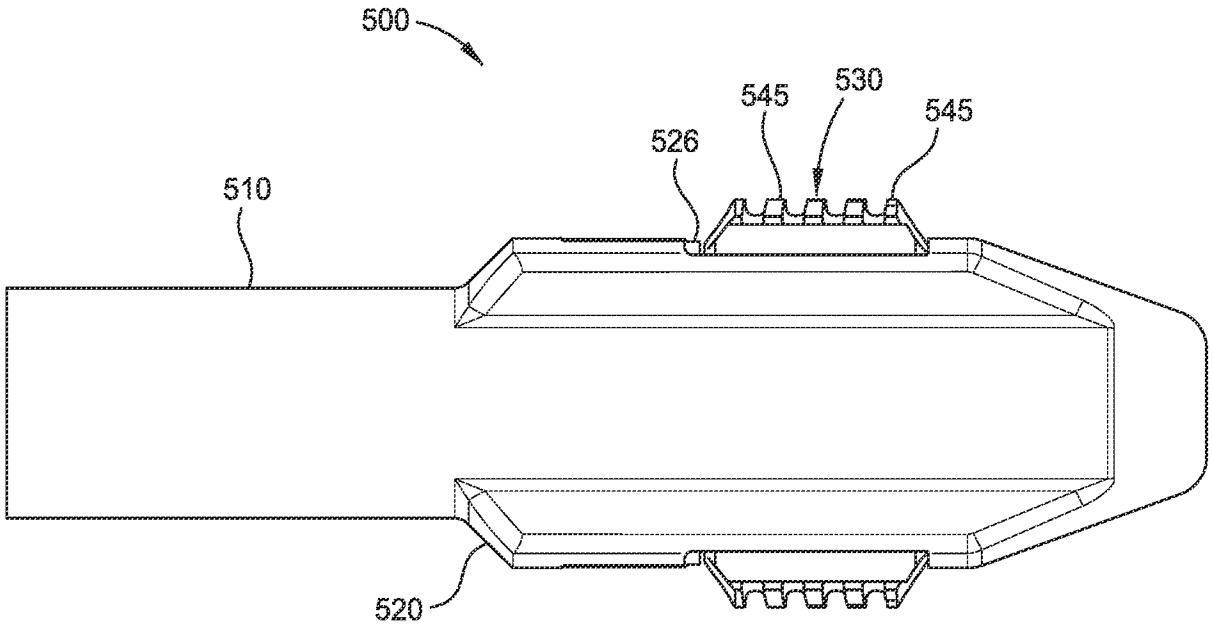
FIG. 9B is a front view of the cleaning tool of FIG. 9A.
Figure 9C:
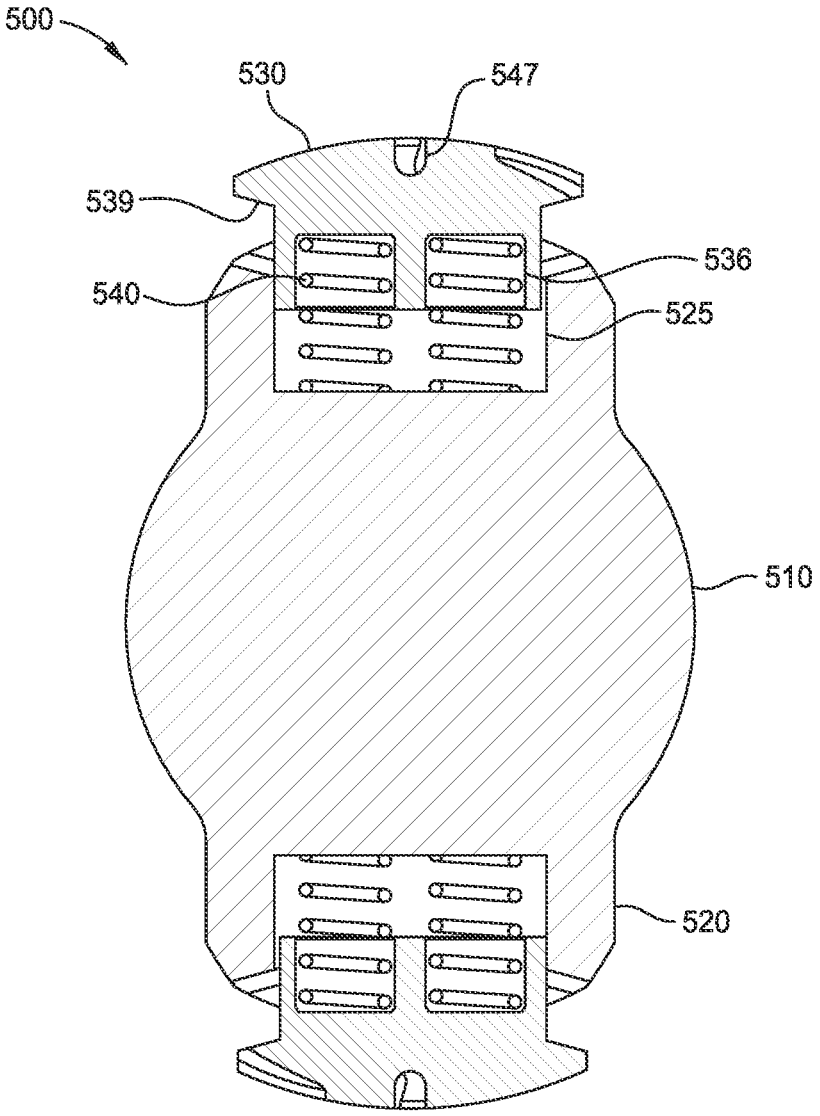
FIG. 9C is a cross-sectional view of the cleaning tool of FIG. 9A.

In one embodiment, the cleaning elements are scraper pads 530. The scraper pads 530 are movable between a retracted position and an extended position. FIGS. 8A-D shows the scraper pads 530 in the retracted position. FIG. 8D is an enlarged, partial, front cross-sectional view of the cleaning tool 500. FIGS. 9A-C show the scraper pads 530 in the extended position. The scraper pads 530 are biased toward the extended position using a plurality of biasing members such as springs 540. The biasing members may be disposed in recesses 536 formed in the scraper pads 530. In one embodiment, a locking member is used to retain the scraper pads 530 in the retracted position during run-in. Exemplary embodiments of the locking member include a shearable mechanism such as a shearable pin and a retractable mechanism such as a retractable latch. When cleaning is desired, the locking member is disengaged to activate the scraper pads 530. The locking member may be configured to disengage in response to a hydraulic force or a compressive force.

In one embodiment, the scraper pad 530 includes a shoulder 533 formed at the upper and lower axial ends of the scraper pad 530. The shoulders 533 are configured to engage flanges 523, 526 formed in the pocket 525. The flanges 523 and the shoulders 533 interact to limit extension of the scraper pad 530 and to prevent the scraper pad 530 from coming out of the pocket 525. In one example, one of the flanges 526 is removable to facilitate installation of the scraper pad 530. The removable flange 526 may be attached using a screw 527. Optionally, the scraper pad 530 includes an upper flange 539 on the sides of the scraper pad 530. The upper flanges 539 are configured to engage an upper surface of the pocket 525 to limit retraction of the scraper pad 530.

In one embodiment, a plurality of raised edges 545 is formed on an upper surface of the scraper pad 530. As shown, the raised edges 545 are aligned horizontally relative to the cylindrical body 510. While five raised edges 545 are shown, any suitable number of raised edges may be used, such as one, two, three, four, six, eight, ten, or more raised edges. In another example, the raised edges are aligned at an angle relative to the cylindrical body 510. In another example, the raised edges on one scraper pad 530 are aligned at a different angle than the raised edges on another scraper pad 530. In another embodiment, the raised edges have different heights on the same or different scraper pads 530. For example, some raised edges are set at a first height, and some raised edges are set at a second height. In one embodiment, a channel 547 is formed through the raised edges 545. The channel 547 may facilitate removal of debris from the raised edges 545 and prevent clogging of the raised edges 545.

In operation, the cleaning tool 500 is attached to the lower end of a BHA. The BHA may include the packer and anchor assembly 210, a whipstock 120, and a mill 150 releasably attached to the whipstock 120.

In one embodiment, the scraper pads 530 are activated to engage the wellbore wall during run-in. For example, the scraper pads are free to compliantly engage the wellbore wall during run-in. In one embodiment, the scraper pads 530 are arranged to minimize encounters with debris. For example, if a high side of the whipstock 120 faces 0 degrees, then one of the scraper pads 530 can be positioned at 90 degrees relative to the high side, and the other scraper pad 530 can be positioned at 180 degrees relative to the high side. During run-in, the scraper pads 530 will contact the side of the casing, instead of the bottom of the casing, thereby minimizing contact with debris.

In another embodiment, the scraper pads 530 are retained in the retracted position during run-in. For example, a locking member is used to keep the scraper pads 530 deactivated. After reaching the desire location, the BHA and the cleaning tool 500 are moved up and down relative to the wellbore to clean the wall of the wellbore. FIGS. 9A-C show the scraper pads 530 in the extended position. If a locking member is used, the locking member is disengaged such as by applying a compressive force or supplying hydraulic force. The BHA and the cleaning tool 500 are optionally rotated relative to the wellbore during cleaning. Because gaps exist between the scraper pads 530, the cleaning tool 500 is optionally rotated relative to the wellbore such that scraper pads 530 can clean the gaps from the previous position of the scraper pads 530.

In one embodiment, the scraper pads 530 are axially aligned with the slips 235 of the anchor assembly 210. For example, the two scraper pads 530 can be axially aligned with two slips 235. In another example, if the anchor assembly 210 has three circumferentially spaced slips 235, then three scraper pads 530 can be provided on the cleaning tool 500 and aligned with the slips 235. Due to the alignment, it would not be necessary to rotate the scraper pads 530 to clean the gaps between scraper pads 530.

In some embodiments, fluid is circulated in the wellbore while operating the cleaning tool. After cleaning the wall, the packer and anchor assembly 210 is set. Optionally, the whipstock 120 is oriented either after or before cleaning the wellbore as described above. Hydraulic fluid can be supplied via the tubing 190 to set the anchor at the location cleaned by the cleaning tool 500. Compressive force is then applied to set the packer. To release the mill 150, additional compressive force is applied to shear the shearable member 128. The mill 150 is now free to move along the whipstock 120 to form a window in the wellbore.

Figure 10A:
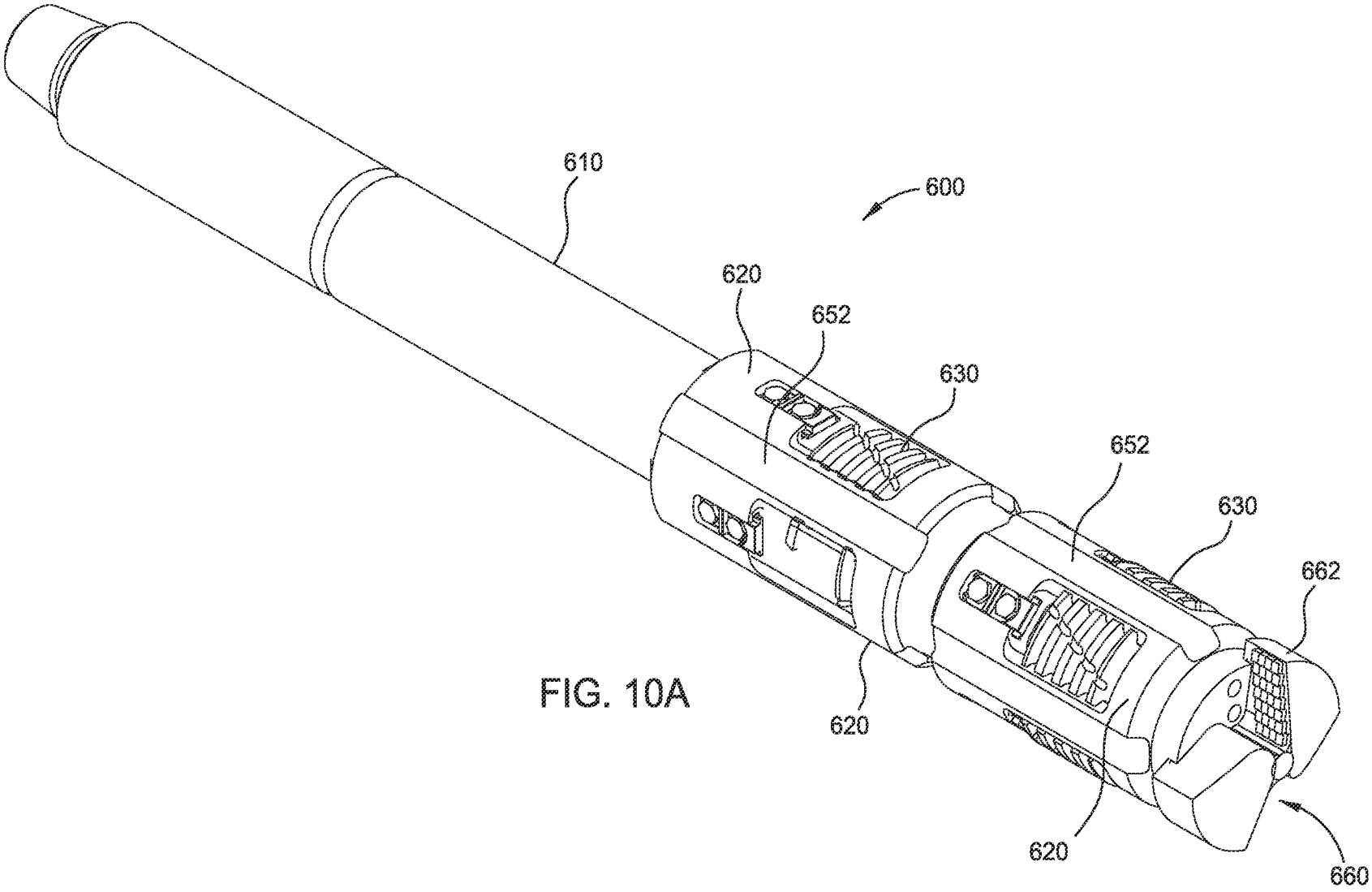
FIG. 10A is a perspective view of another embodiment of a cleaning tool.
Figure 10B:
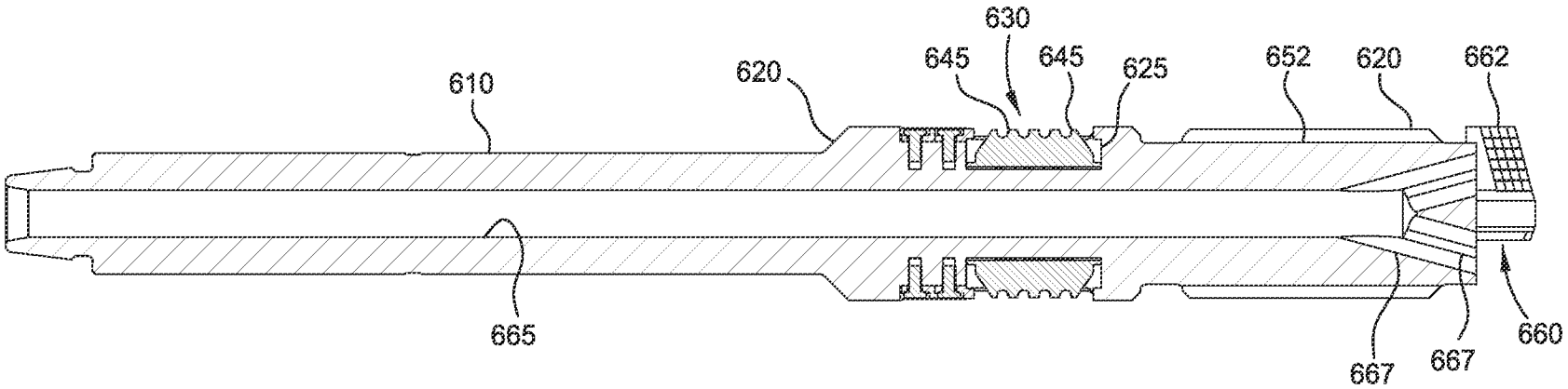
FIG. 10B is a front cross-sectional view of the cleaning tool of FIG. 10A.
Figure 10C:
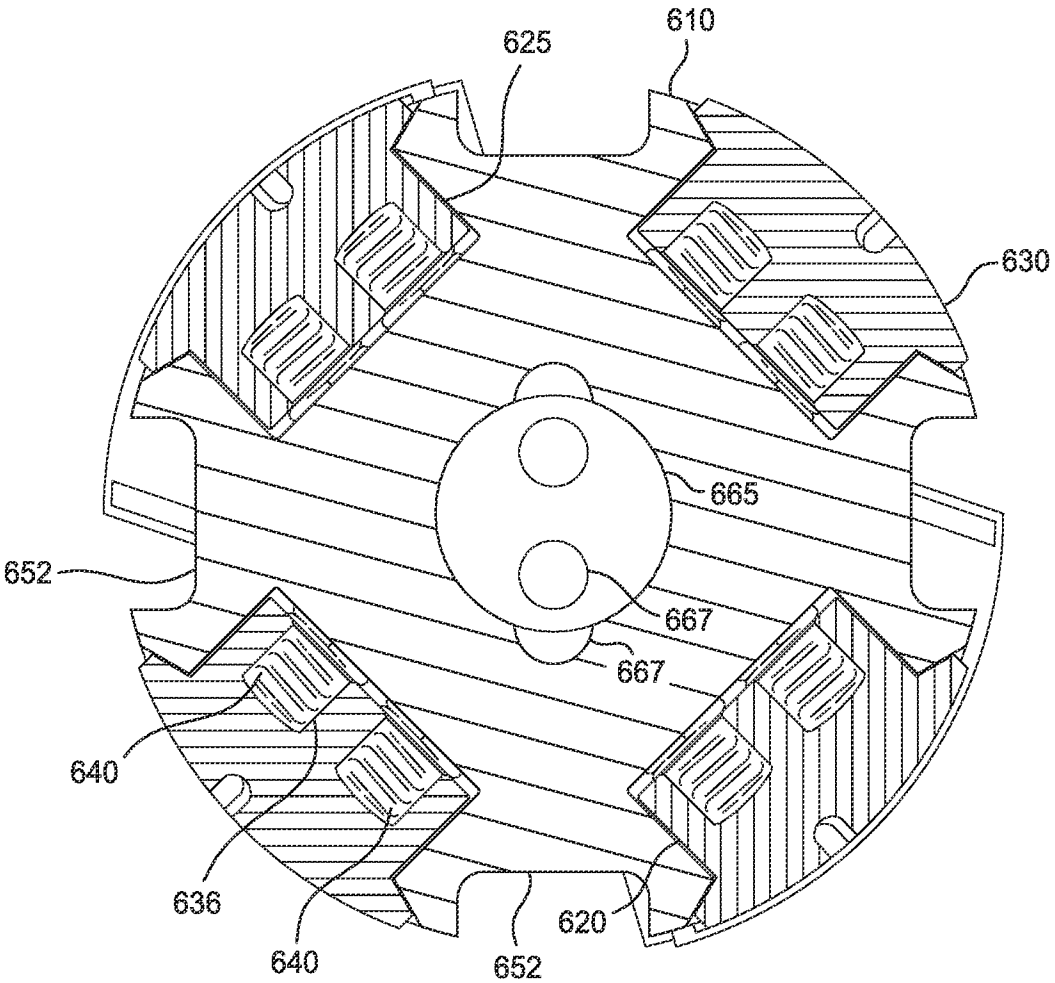
FIG. 10C is a cross-sectional view of the cleaning tool of FIG. 10A.

FIGS. 10A-C illustrate another embodiment of a cleaning tool 600 suitable for use with a BHA. The cleaning tool 600 may be used as the cleaning tool 1050 shown in FIG. 1A. FIG. 10A is a perspective view of the cleaning tool 600. FIG. 10B is a front cross-sectional view of the cleaning tool 600. FIG. 10C is a cross-sectional view of the cleaning tool 600. The cleaning tool 600 is similar to the cleaning tool 500 of FIG. 8A, and, for sake of clarity, many of the same features will not be further described in detail. The cleaning tool 600 includes a body 610 and a plurality of cleaning elements 630 at least partially disposed in the body 610. In this embodiment, the body 610 is a tubular body having eight raised profiles 620 for housing eight cleaning elements 630. The cleaning elements 630 are disposed in a pocket 625 formed in the raised profiles 620.

In one embodiment, the cleaning elements are scraper pads 630. A first set of four scraper pads 630 are circumferentially spaced around the tubular body 610. A second set of four scraper pads 630 are disposed axially above the first set of scraper pads 630. Other suitable numbers of scraper pads and arrangements are envisioned. For example, three sets of three scraper pads can be arranged on the body 610. Flow channels 652 are formed between two adjacent scraper pads 630. In this embodiment, the flow channels 652 of the second set of scraper pads 630 are not axially aligned with the flow channels 652 of the first set of scraper pads 630. The scraper pads 630 are movable between a retracted position and an extended position. The scraper pads 630 are biased toward the extended position using a plurality of biasing members such as springs 640. The biasing members may be disposed in recesses 636 formed in the scraper pads 630. In one embodiment, a locking member is used to retain the scraper pads 630 in the retracted position during run-in. A plurality of raised edges 645 are formed on an upper surface of the scraper pad 630. As shown, the raised edges 645 are aligned horizontally relative to the cylindrical body 610.

In one embodiment, the cleaning tool 600 includes a mill head 660 disposed at a lower end thereof. The mill head 660 is shown with two blades 662, but could have three, four, five, or more blades. The tubular body 610 includes a central bore 665. The central bore 665 fluidly communications with a plurality of exit bores 667 located at the lower end of the tubular body 610. Fluid can be supplied through the central bore 665 and the exit bores 667 for fluid circulation during the cleaning process.

Figure 11A:
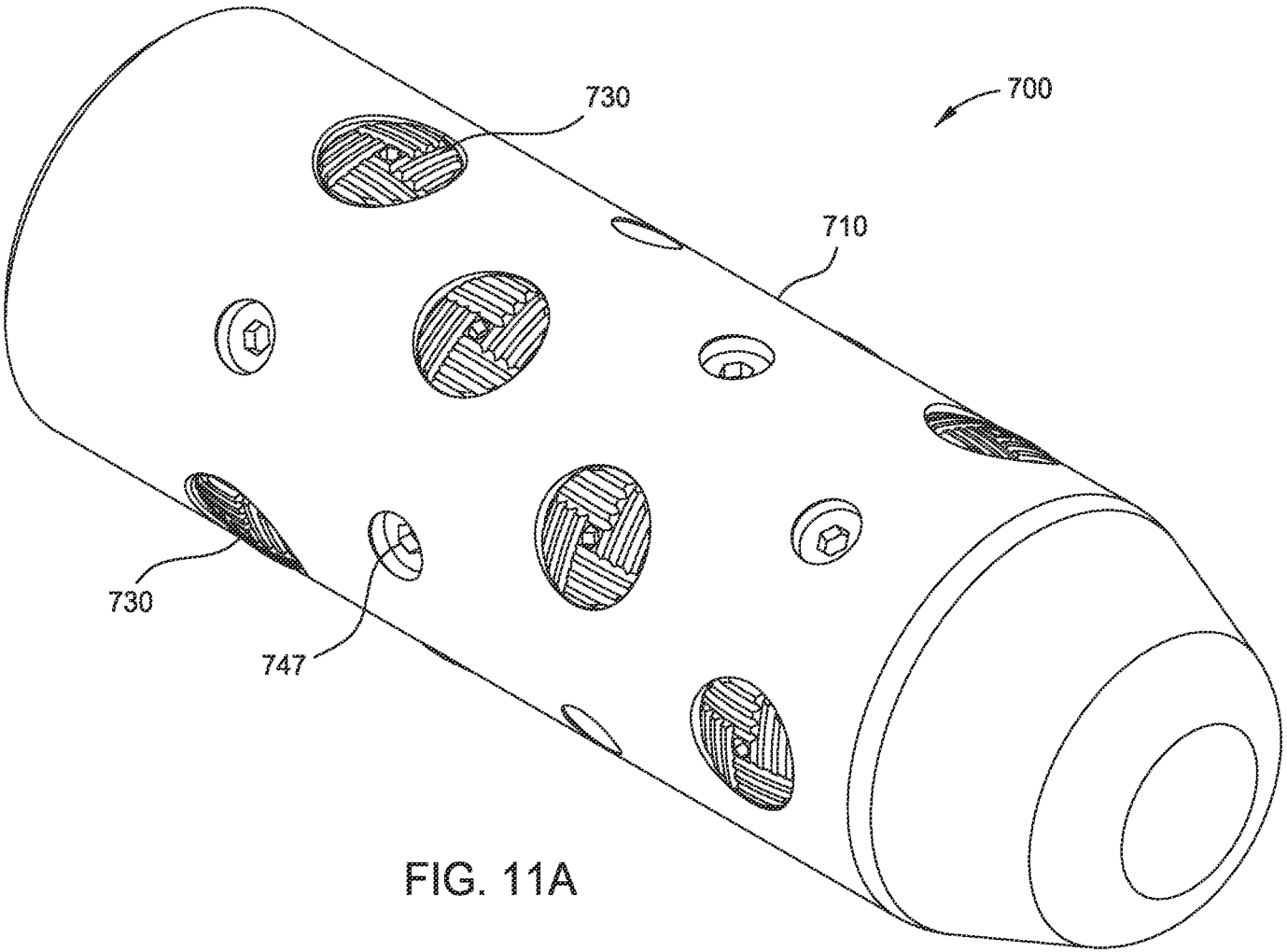
FIG. 11A is a perspective view of another embodiment of a cleaning tool.
Figure 11B:
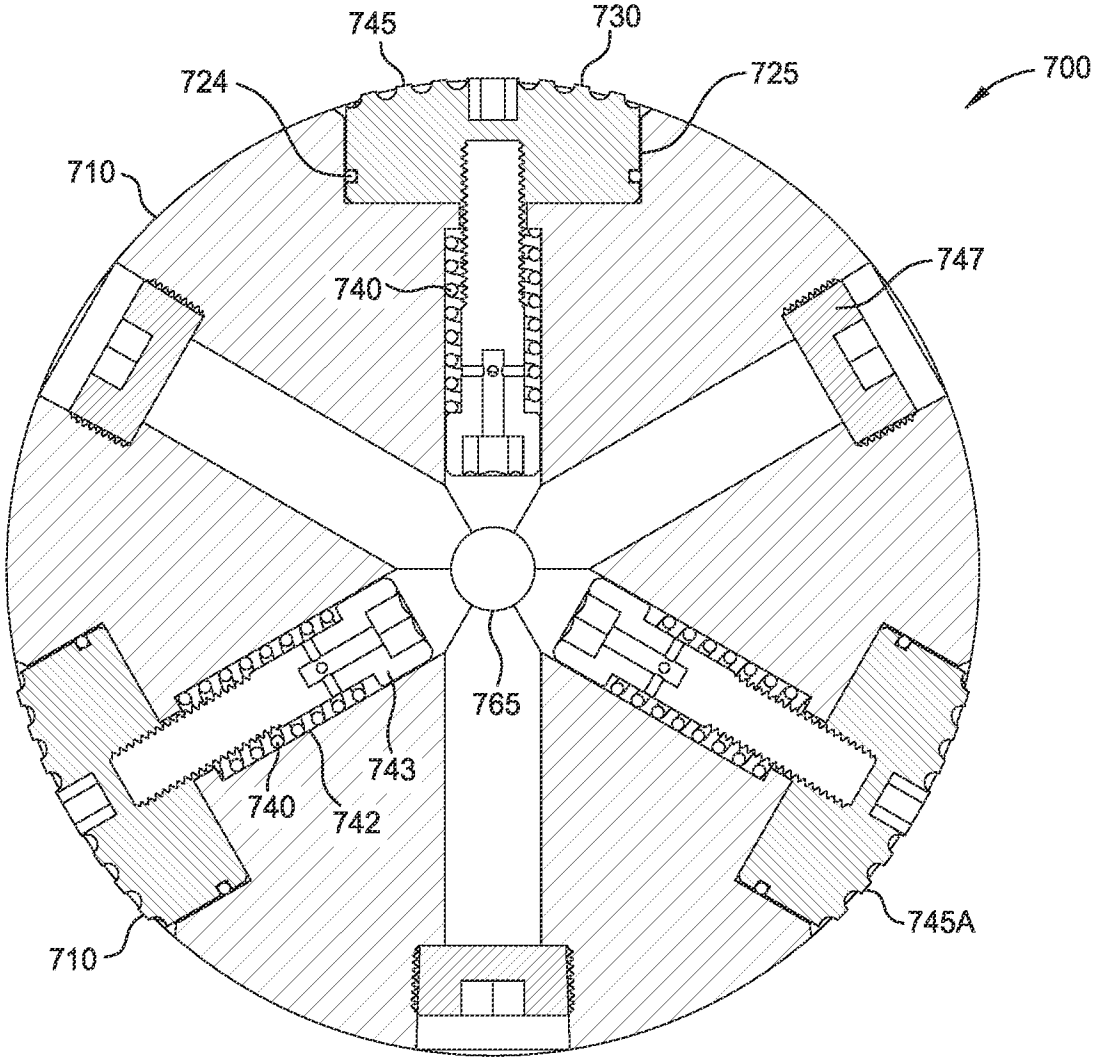
FIG. 11B is a cross-sectional view of the cleaning tool of FIG. 11A.
Figure 11C:
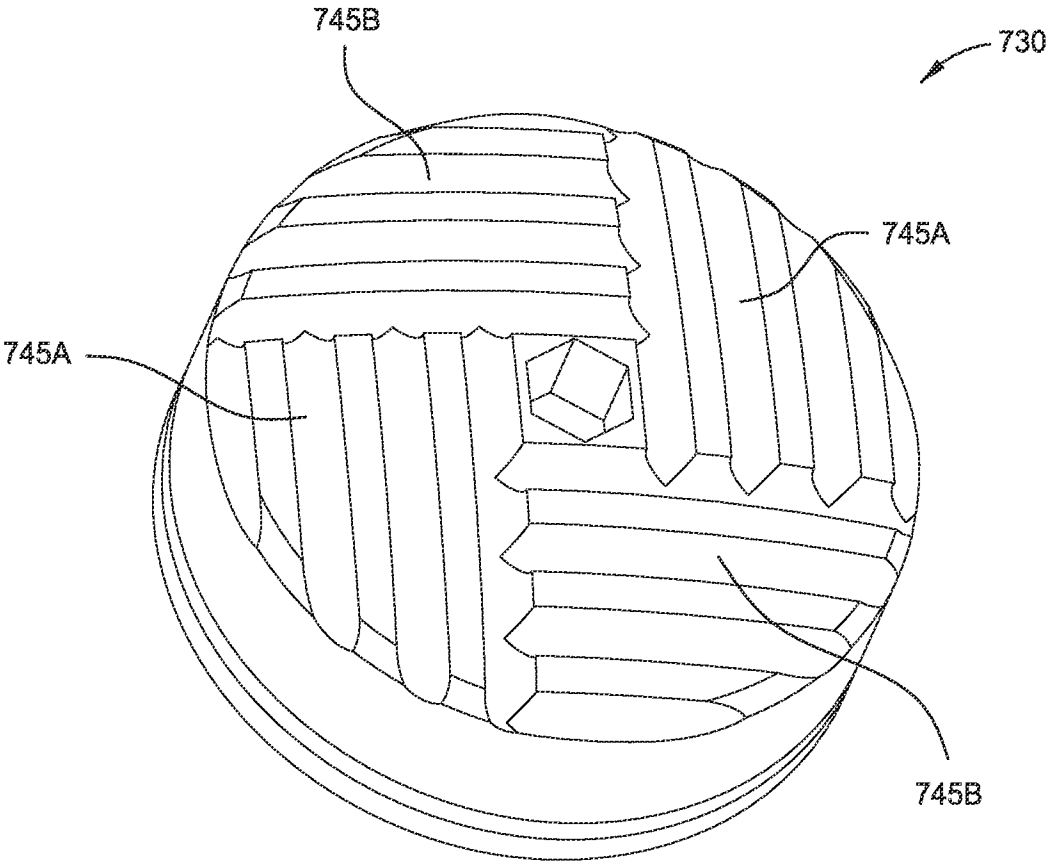
FIG. 11C is a perspective view of an exemplary embodiment of a scraper pad of the cleaning tool FIG. 11A.

FIGS. 11A-C illustrate another embodiment of a cleaning tool 700 suitable for use with a BHA. The cleaning tool 700 may be used as the cleaning tool 1050 shown in FIG. 1A. FIG. 11A is a perspective view of the cleaning tool 700. FIG. 11B is a cross-sectional view of the cleaning tool 700. FIG. 11C is a perspective view of a scraper pad 730 of the cleaning tool 700. The cleaning tool 700 includes a body 710 and a plurality of cleaning elements 710 at least partially disposed in the body 710. In one embodiment, the body 710 is a tubular body having a plurality of pockets 725 for housing the cleaning elements 730.

Figure 12A:
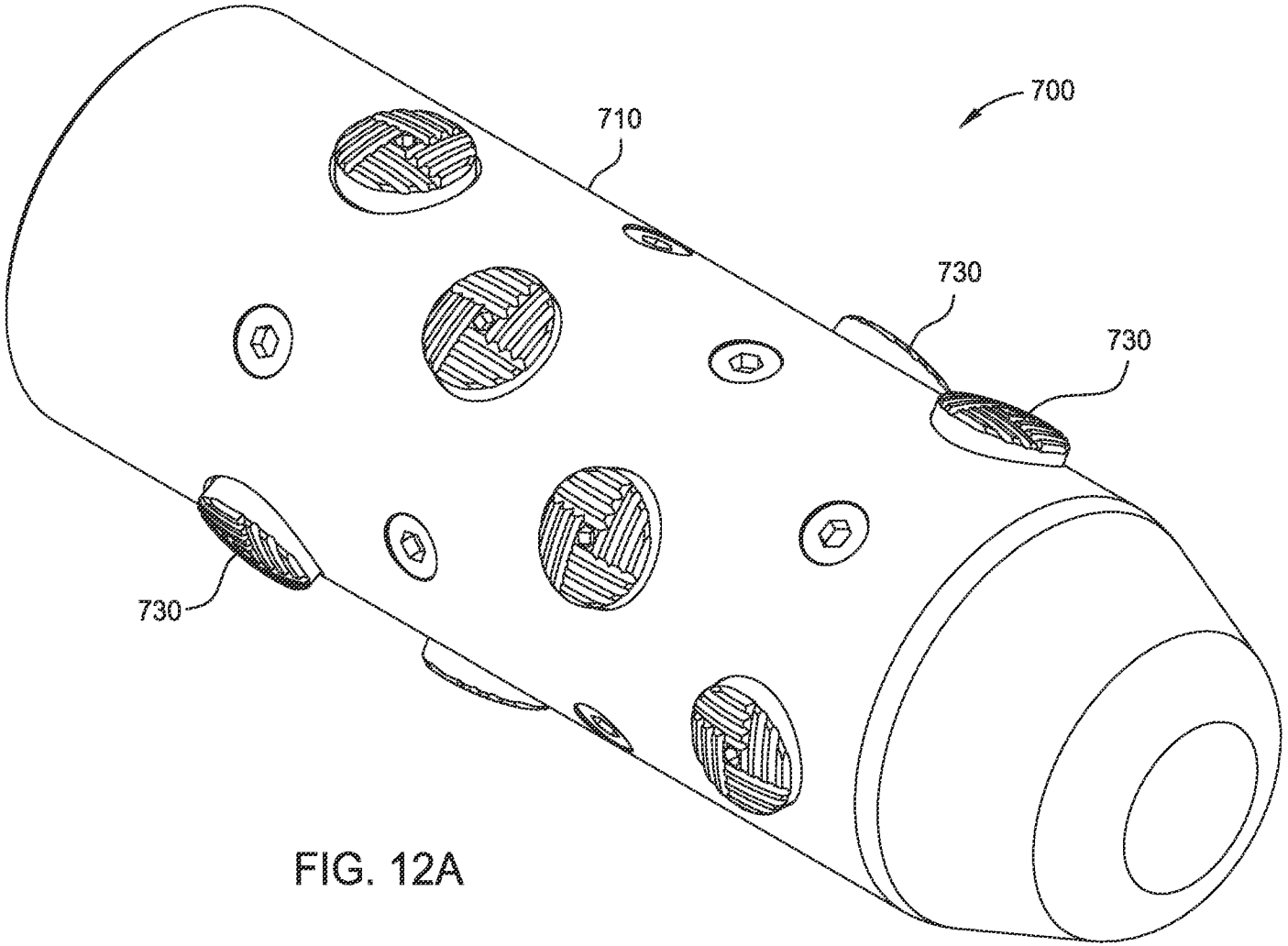
FIG. 12A is a perspective view of the cleaning tool of FIG. 11A in an activated position.
Figure 12B:
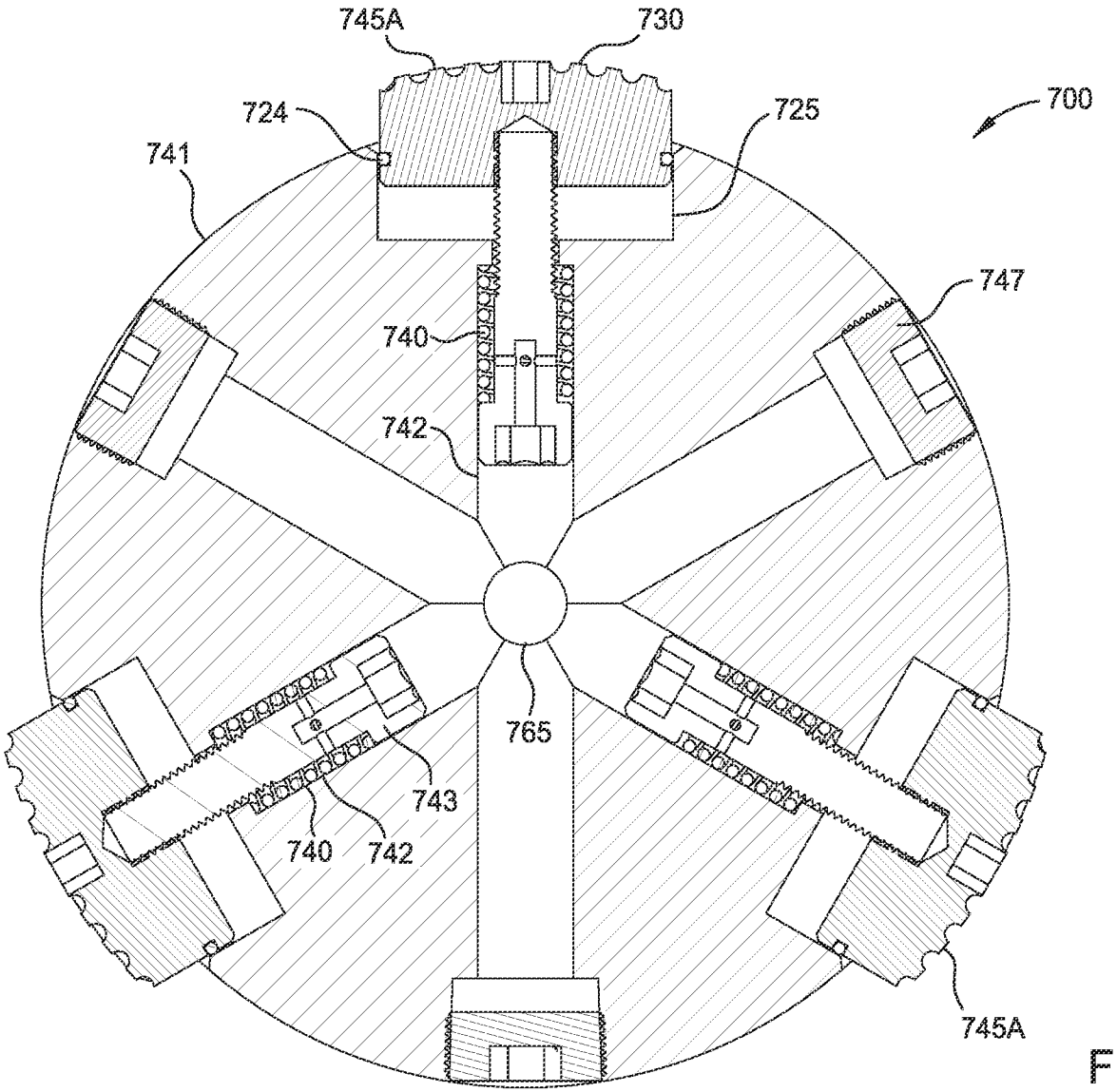
FIG. 12B is a cross-sectional view of the cleaning tool of FIG. 12A.

In one embodiment, the cleaning elements are scraper pads 730. The scraper pads 730 are movable between a retracted position and an extended position. FIGS. 11A-B shows the scraper pads 730 in the retracted position. The scraper pads 730 are shown retracted in a pocket 725 of the body 710. A sealing member such as an o-ring 724 is disposed between the scraper pad 730 and the pocket 725. A guide 743, such as a rod, is threadedly attached to the scraper pad 730 and is disposed in a side bore 742. The side bore 742 fluidly communicates with a central bore 765 of the tubular body 710. The scraper pads 730 are biased toward the retracted position using a plurality of biasing members such as springs 740. The spring 740 is disposed around the guide 743 and between a shoulder of the guide 743 and a shoulder of the side bore 742. FIGS. 12A-B show the scraper pads 730 in the extended position. The scraper pads 730 may be extended by pressurizing the central bore 765 and the side bores 742. In one example, the side bore 742 can be formed by drilling through the body 710 from an end opposite the pocket 725. After installation of the guide 743 and the spring 740, a plug 747 is installed at the opposite end to close off the side bore 742.

An exemplary scraper pad 730 is shown in FIG. 11C. The scraper pad 730 has a circular body and includes a plurality of raised edges 745A-B formed on different sections of the scraper pad 730. In this example, the raised edges 745A in two sections are aligned in a different direction relative to the raised edges 745B in two other sections. While three raised edges 745A-B are shown for each section, any suitable number of raised edges may be used, such as one, two, four, five, six, or more raised edges. In another embodiment, the raised edges 745A-B have different heights on the same or different scraper pads 730. For example, some raised edges are set at a first height, and some raised edges are set at a second height.

Figure 11D:
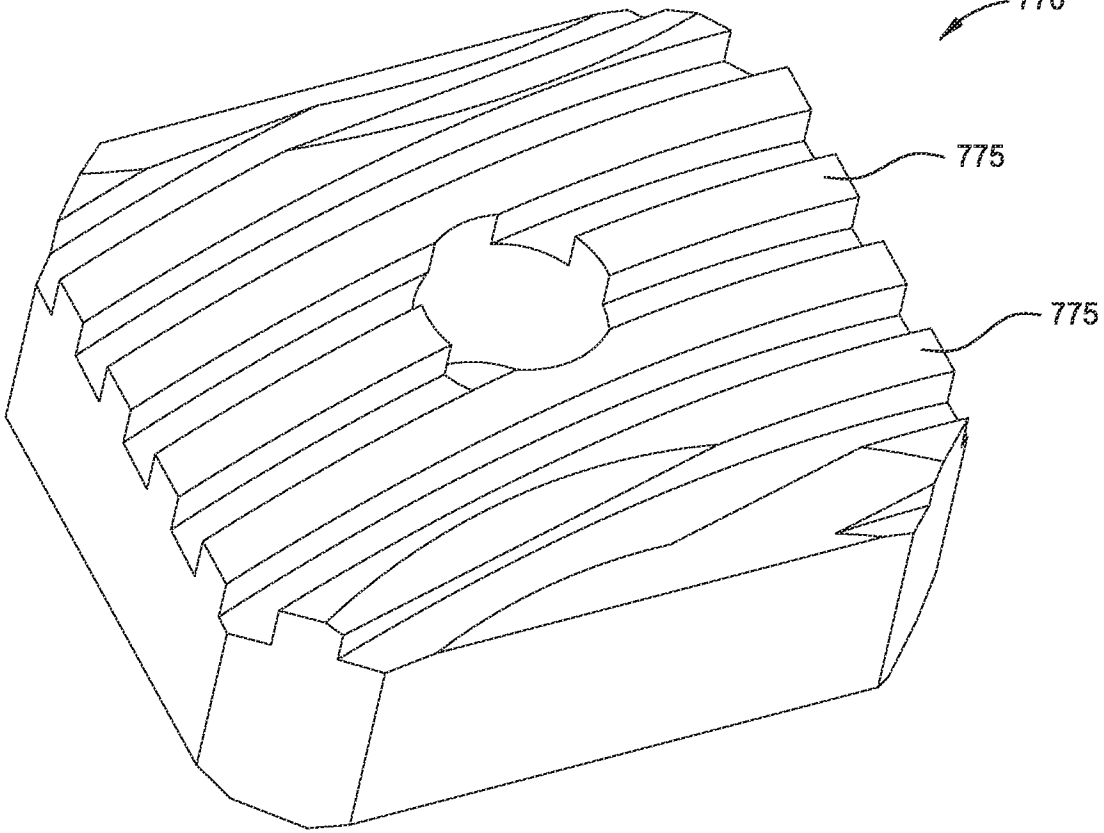
FIG. 11D is a perspective view of another exemplary embodiment of a scraper pad of the cleaning tool FIG. 11A.

FIG. 11D illustrate another embodiment of a scraper pad 770. The scraper pad 770 has a rectangular body and includes a plurality of raised edges 775 formed on an upper surface of the body. In this example, the raised edges 775 are shaped like splines and are disposed between grooves. Any suitable number of raised edges may be used, such as one, two, four, five, six, or more raised edges. In another embodiment, the raised edges 775 have different heights on the same or different scraper pads 770. For example, some raised edges are set at a first height, and some raised edges are set at a second height.

The plurality of scraper pads 730, 770 can be arranged on the body 710 in any suitable arrangement. As shown in FIG. 12A, the scraper pads 730 are arranged circumferentially in a row around the body 710. A plurality of rows is arranged vertically along the body 710, and each row is rotated slightly relative to an adjacent row. The scraper pads are spaced sufficiently to minimize clogging between scraper pads 730 while cleaning debris. In another embodiment, each row may include two, four, or six scraper pads.

In operation, the cleaning tool 700 is attached to the lower end of a BHA. For example, the BHA can be the BHA 1000 shown in FIG. 1A. In one embodiment, the BHA includes the packer and anchor assembly 210, a whipstock 120, and a mill 150 releasably attached to the whipstock 120. During run-in, the scraper pads 730 are retracted by the spring 740.

After reaching the desire location, the scraper pads 730 are activated to contact the wall of the wellbore. Pressure in the central bore 765 is increased to overcome the biasing force of the spring 740, thereby extending the scraper pads 770 outward. The BHA and the cleaning tool 700 are moved up and down relative to the wellbore to clean the section of the wall where the anchor will be set. FIGS. 12A-B show the scraper pads 730 in the extended position. The BHA and the cleaning tool 700 are optionally rotated relative to the wellbore during cleaning.

In some embodiments, fluid is circulated in the wellbore while operating the cleaning tool. After cleaning the wall, the packer and anchor assembly 210 is set. Optionally, the whipstock 120 is oriented either after or before cleaning the wellbore as described above. Hydraulic fluid can be supplied via the tubing 190 to set the anchor at the location cleaned by the cleaning tool 700. Compressive force is then applied to set the packer. To release the mill 150, additional compressive force is applied to shear the shearable member 128. The mill 150 is now free to move along the whipstock 120 to form a window in the wellbore.

Figure 13:
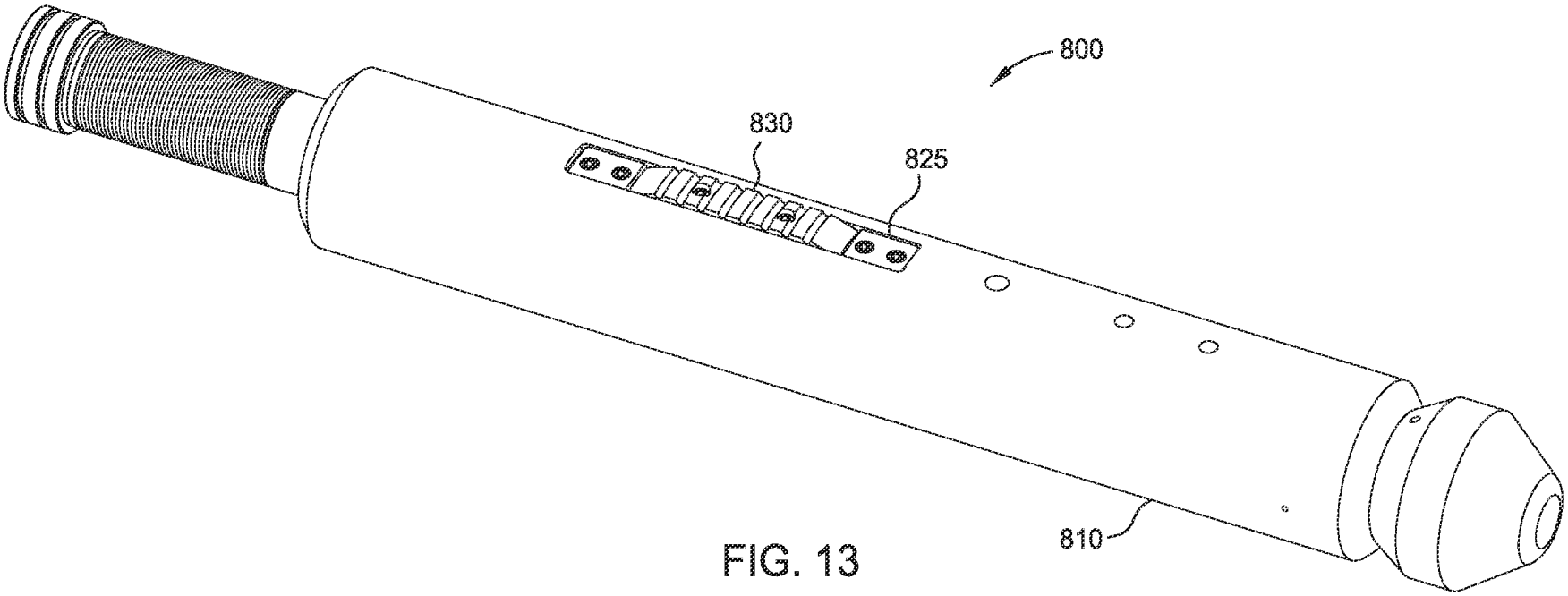
FIG. 13 is a perspective view of another embodiment of a cleaning tool.
Figure 13A:
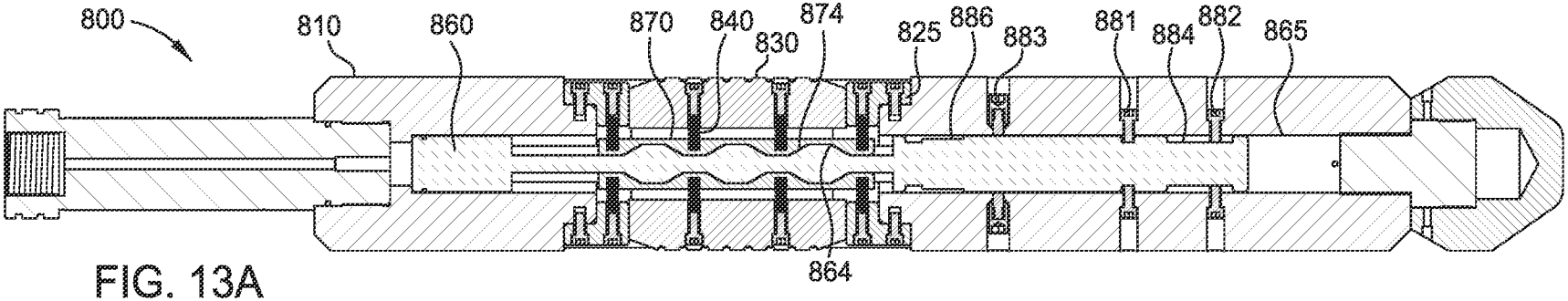
FIGS. 13A-C are cross-sectional views of a sequential operation of the cleaning tool of FIG. 13.
Figure 13B:
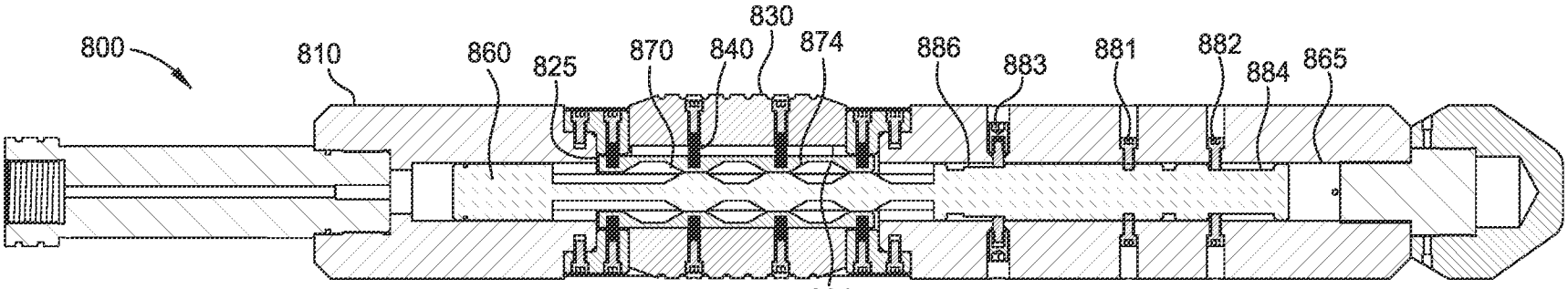
Figure 13C:
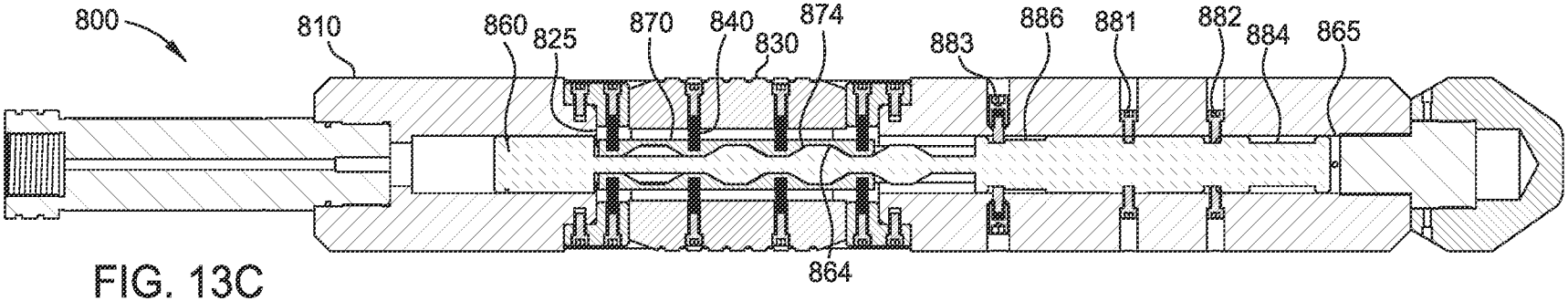

FIG. 13 is a perspective view of another embodiment of a cleaning tool 800 suitable for use with a BHA. The cleaning tool 800 may be used as the cleaning tool 1050 shown in FIG. 1A. FIG. 13A is a cross-sectional view of the cleaning tool 800. FIGS. 13B-C are cross-sectional views of sequential operation of the cleaning tool 800. The cleaning tool 800 includes a body 810 and a plurality of cleaning elements 830 at least partially disposed in the body 810. In one embodiment, the body 810 is a tubular body having a central bore 865 and a plurality of pockets 825 formed in body 810 to house the cleaning elements 830. In this embodiment, two pockets 825 are arranged on opposite sides of the body 810. Although two pockets 825 are shown, the cleaning tool 800 may have any suitable number of pockets 825 for housing a corresponding number of the cleaning elements.

Figure 14A:
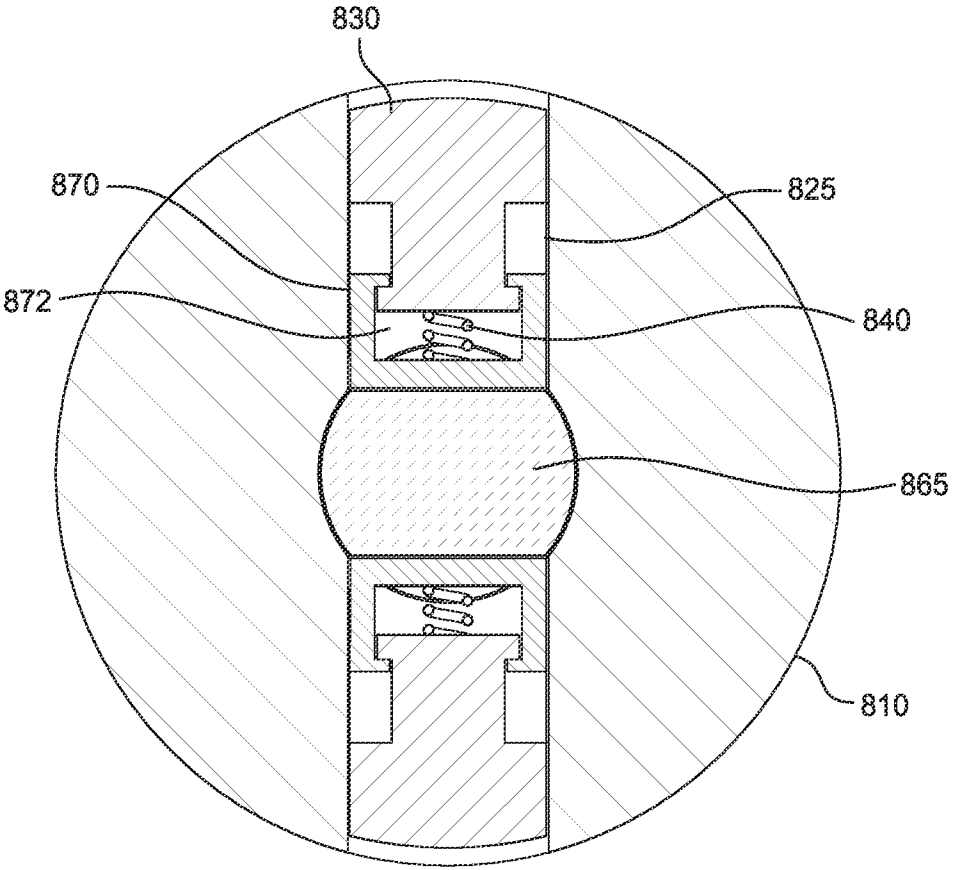
FIG. 14A is a cross-sectional view of the cleaning tool of FIG. 13A.
Figure 14B:
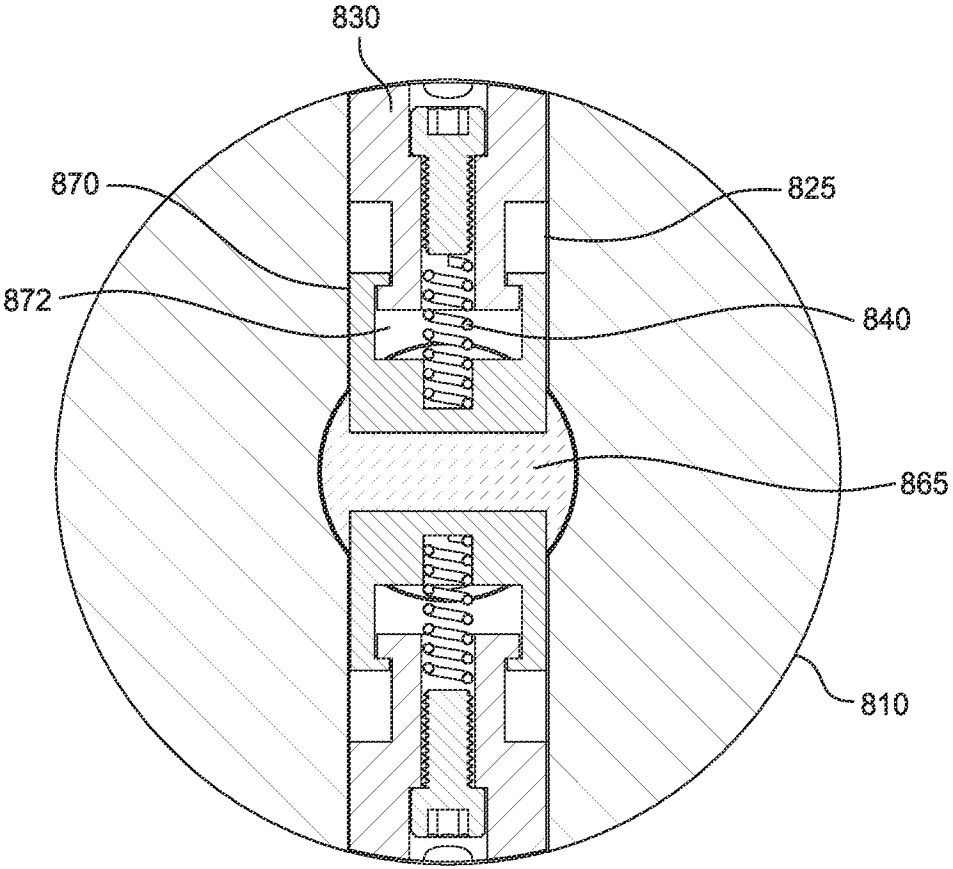
FIG. 14B is another cross-sectional view of the cleaning tool of FIG. 13A.

In one embodiment, the cleaning elements are scraper pads 830. The scraper pads 830 are movable between a retracted position and an extended position. FIGS. 13 and 13A show the scraper pads 830 in the retracted position. FIGS. 14A-B are cross-sectional views of two different sections of the cleaning tool 800 with the scraper pads 830 in the retracted position. The scraper pads 830 may be hydraulically activated between the retracted and extended positioned. The scraper pads 830 are coupled to a guide 870 disposed in the pocket 825. In one embodiment, the upper portion of the guide 870 includes a flange for engaging a flange formed on a lower portion of the scraper pad 830, as shown in FIGS. 14A and 14B. Interaction between the flanges limit upward movement of the scraper pad 730 relative to the guide 870. The lower portion of the scraper pad 830 is movable in a groove 872 of the guide 870. A plurality of biasing members 840 are used to bias the scraper pads 830 against the guide 870. An exemplary biasing member 840 is a spring. The spring keeps the scraper pad 830 in the outward position relative to the guide 870. However, the scraper pad 830 is allowed to move inward is a restriction or obstruction is encountered.

A piston 860 is disposed in the bore 865 and configured to engage the guide 870. In one embodiment, the piston 860 includes an actuating profile 864 engageable with a mating profile 874 formed on the lower end of the guide 870. The actuating profile 864 and the mating profile 874 may be an undulating profile having peaks and valleys. In FIG. 13A, the peaks of the actuating profile 864 are engaged with the valleys of the mating profile 874. In this position, the scraper pads 830 are retracted. A first shearable member 881 is used to retain the piston 860 in this position during run-in. A second shearable member 882 is engaged with a first slot formed on an outer surface of the piston 860. An exemplary shearable member 881, 882 is a shearable pin. An extendable locking member 883 is biased against an outer surface of the piston 860.

In one embodiment, a plurality of raised edges 845 is formed on an upper surface of the scraper pad 830. As shown, the raised edges 845 are aligned horizontally relative to the tubular body 810. Any suitable number of raised edges 845 may be used, such as one, two, four, six, eight, ten, or more raised edges. In another example, the raised edges are aligned at an angle relative to the cylindrical body 810. In another embodiment, the raised edges have different heights on the same or different scraper pads 830. For example, some raised edges are set at a first height, and some raised edges are set at a second height.

In operation, the cleaning tool 800 is attached to the lower end of a BHA. For example, the BHA can be the BHA 1000 shown in FIG. 1A. In one embodiment, the BHA may include the packer and anchor assembly 210, a whipstock 120, and a mill 150 releasably attached to the whipstock 120. During run-in, the scraper pads 830 are in the retracted position as shown in FIGS. 13 and 13A.

Figure 15A:
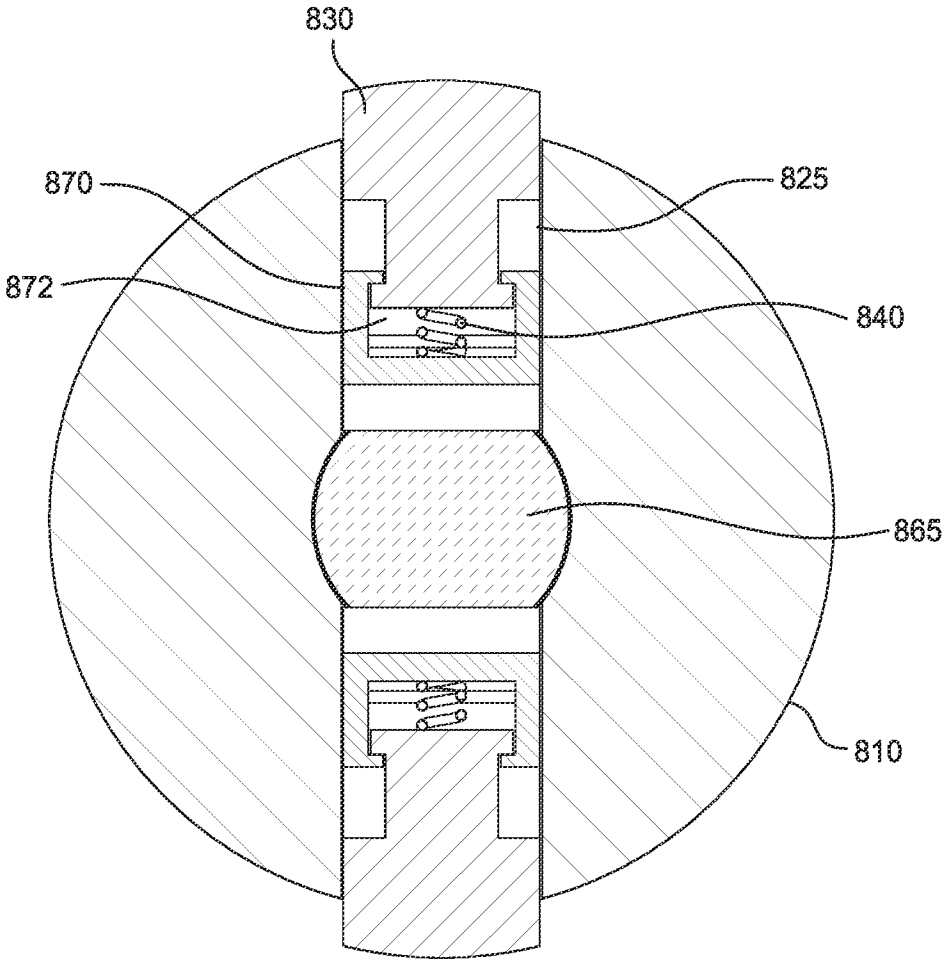
FIG. 15A is a cross-sectional view of the cleaning tool of FIG. 13B.
Figure 15B:
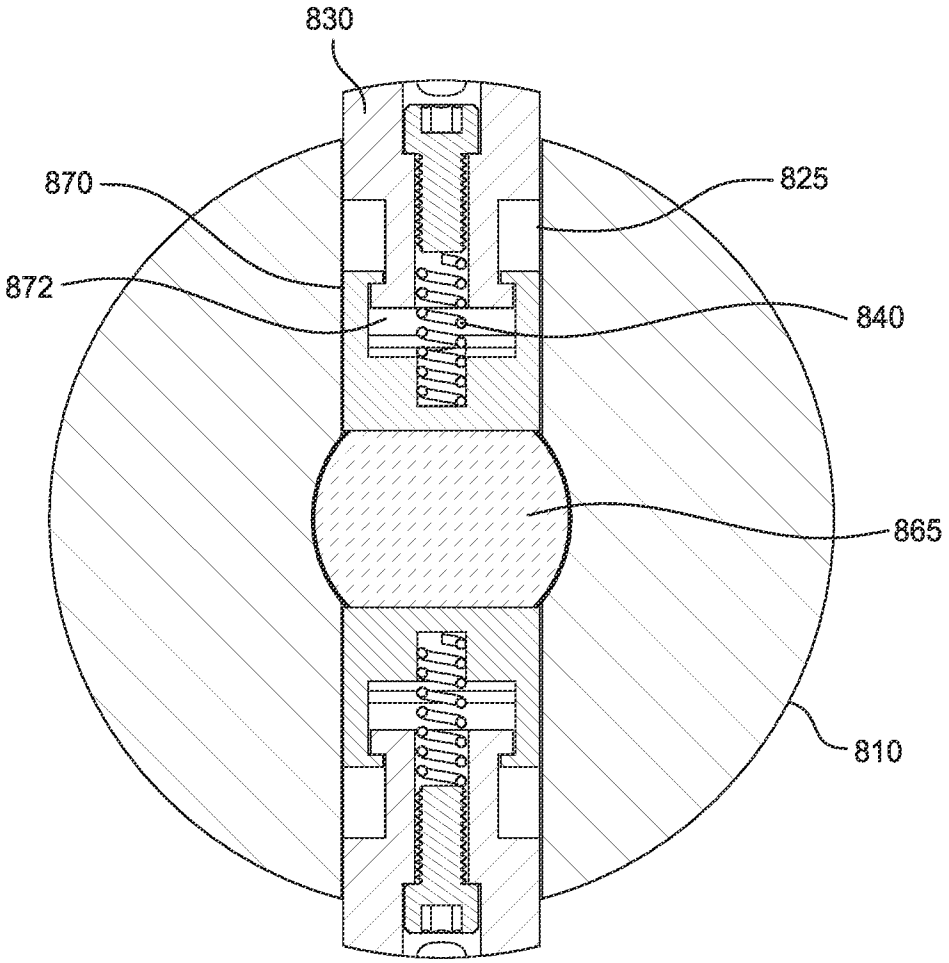
FIG. 15B is another cross-sectional view of the cleaning tool of FIG. 13B.

After reaching the desire location, the scraper pads 830 are activated to contact the wall of the wellbore. Pressure in the central bore 865 is increased to shear the first shearable member 881. Thereafter, the piston 860 is urged toward the lower end of the body 810 and relative to the guide 870. Movement of the piston 860 is stopped when the second shearable member 881 reaches the end of the first slot 884, as shown in FIG. 13B. The retractable member 883 has been extended to engage a first depth of the second slot 886. The piston 860 has moved relative to the guide 870 such that the peaks of the actuating profile 864 are engaged with the peaks of the mating profile 874. In this respect, the guide 870 is urged radially outward, thereby moving the scraper pads 830 to the extended position. FIGS. 15A and 15B show the scraper pads 830 in the extended position. The BHA and the cleaning tool 800 are moved up and down relative to the wellbore to clean the section of the wall where the anchor will be set. The BHA and the cleaning tool 800 are optionally rotated relative to the wellbore during cleaning. Because gaps exist between the scraper pads 830, the cleaning tool 800 is optionally rotated relative to the wellbore such that scraper pads 830 can clean the gaps from the previous position of the scraper pads 830. In some embodiments, fluid is circulated in the wellbore while operating the cleaning tool.

In one embodiment, the scraper pads 830 are axially aligned with the slips 235 of the anchor assembly 210. For example, the two scraper pads 830 can be axially aligned with two slips 235. Due to the alignment, it would not be necessary to rotate the scraper pads 830 to clean the gaps therebetween.

After cleaning the wall, additional pressure is supplied to shear the second shearable member 882. Thereafter, the piston 860 is moved further toward the lower end of the body 810 and relative to the guide 870. Movement of the piston 860 is stopped when the retractable member 883 reaches the end of the second slot 886, as shown in FIG. 13C. As shown, the retractable member 883 has extended further to engage a second depth of the second slot 886. In this respect, the piston 860 is no longer allowed to move axially in the bore 865. After moving the piston 860 relative to the guide 870, the peaks of the actuating profile 864 are engaged with the valleys of the mating profile 874. In this respect, the guide 870 is allowed to move radially inward, thereby moving the scraper pads 830 to the retracted position. FIG. 13C show the scraper pads 830 in the retracted position. Optionally, the whipstock 120 is oriented either after or before cleaning the wellbore as described above.

After cleaning the wall, the packer and anchor assembly 210 is set. Hydraulic fluid can be supplied via the tubing 190 to set the anchor. For example, hydraulic is supplied to the chamber 226 to urge the actuating sleeve 220 upward, thereby moving the lower wedge member 242 closer to the upper wedge member 241. As a result, the slips 235 are urged up the inclined of the wedge members and outwardly into engagement with the surround casing. After setting the slips 235, weight is set down on the whipstock 120, thereby compressing the sealing element 230 between the shoulder of the mandrel 211 and the upper wedge member 241. The sealing element 230 is urged outwardly into engagement with the surrounding casing to seal off fluid communication through the annulus.

Additional pressure is applied to the mill 150 to release the mill 150 from the whipstock 120. For example, sufficient pressure is applied from the surface to break the shearable lug or screw 128 connecting the mill 150 to the whipstock 120. The mill 150 is then urged along the concave member of the whipstock 120, which deflects the mill 150 outward into engagement with the casing.

Figures 16A, 16B, 16C, 16D, 16E, 16F, 16G:
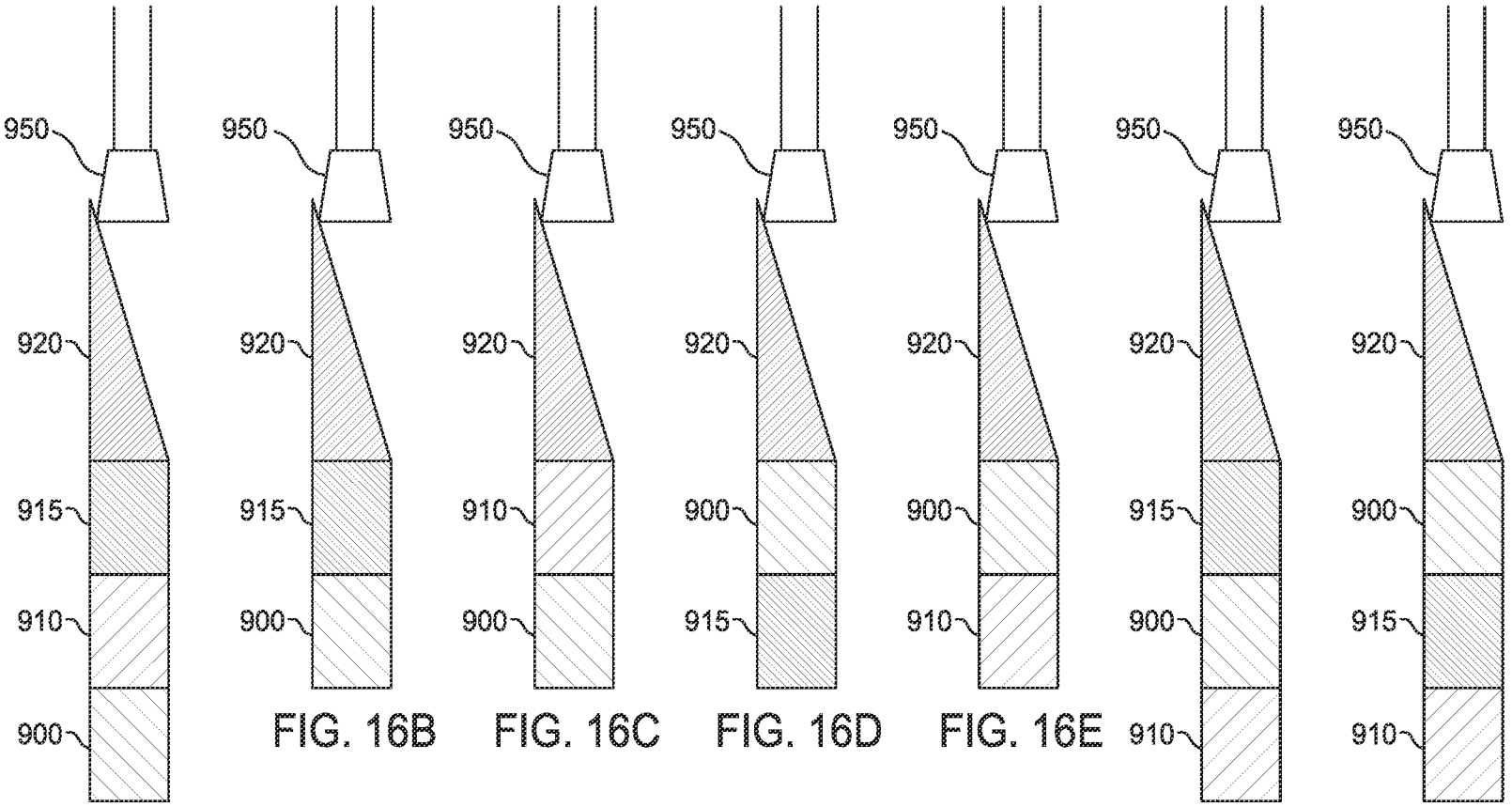
FIGS. 16A-16G illustrate exemplary arrangements of one or more downhole tools and a cleaning tool.

For any of the embodiments described herein, it is contemplated the bottom hole assembly can have any suitable combination of downhole tools coupled to the cleaning tool. For example, the BHA can have any suitable combination of a whipstock, one or more downhole tools, and a cleaning tool. In one example, a packer 915, an anchor 910, and a cleaning tool 900 can be sequentially coupled to whipstock 920, as shown in FIG. 16A. In another example, the downhole tools can be arranged in any suitable order; such as the packer 915, the cleaning tool 900, and then the anchor 910, as shown in FIG. 16F; or the cleaning tool 900, the packer 915, and then the anchor 910, as shown in FIG. 16G. In one example, the packer and the anchor are combined as a single downhole tool. In another example, the cleaning tool is integral with a downhole tool such as an anchor, a packer, a whipstock, or combinations thereof. In yet another example, a packer 915 and a cleaning tool 900 are attached in order, or in reverse order, below the whipstock 920, as shown in FIG. 16B and FIG. 16D, respectively. In yet another example, an anchor 910 and a cleaning tool 900 are attached in order, or in reverse order, below the whipstock 920, as shown in FIG. 16C and FIG. 16E, respectively. In one embodiment, the whipstock 920 can be releasably attached to an optional milling tool 950.

In one embodiment, a bottom hole assembly having a cleaning tool and a downhole tool is lowered into the wellbore. After reaching the desire location, the cleaning tool is reciprocated up and down relative to the wellbore to clean at least a portion of the wall of the wellbore. Optionally, the cleaning tool is rotated relative to the wellbore while cleaning. In some embodiments, fluid is circulated in the wellbore while operating the cleaning tool. After cleaning the wall, the downhole tool is activated into contact with the cleaned portion of the wall. In on example, hydraulic fluid can be supplied via the tubing 190 to activate the downhole tool. For example, the downhole tool can be an anchor, and hydraulic is supplied to activate the slips. The slips are set in the cleaned portion of the wellbore wall. After setting the slips, if the BHA includes a packer, then weight is applied to set the packer. The packer optionally engages the cleaned portion of the wellbore wall.

If the BHA includes a whipstock, then the whipstock is oriented to the desired azimuth after cleaning the wellbore and before setting the anchor. For example, the cleaning tool is reciprocated to clean the wellbore. The cleaning tool can optionally be rotated during cleaning. After cleaning, the whipstock can be oriented using a Measurement-While-Drilling (MWD) unit coupled to or integral with the BHA. The anchor is then set in a cleaned portion of the wellbore.

In another embodiment, the whipstock is oriented before cleaning the wellbore. For example, the whipstock can be oriented using a Measurement-While-Drilling (MWD) unit coupled to or integral with the BHA. After orienting the whipstock, the cleaning tool is reciprocated to clean the wellbore. In one example, the cleaning tool is not rotated during cleaning. After cleaning, the anchor is set in a cleaned portion of the wellbore.

If the BHA includes a mill attached to the whipstock, then additional pressure is applied to the mill to release the mill from the whipstock. For example, sufficient pressure is applied from the surface to break a shearable lug or screw connecting the mill to the whipstock. The mill is then urged along the concave member of the whipstock, which deflects the mill outward into engagement with the casing.

In another embodiment, a method of positioning a bottom hole assembly in a wellbore includes lowering the bottom hole assembly into the wellbore, the bottom hole assembly having a downhole tool and a cleaning tool having a cleaning element. The method also includes cleaning at least a portion of a wall of the wellbore using the cleaning tool and activating the downhole tool to engage the cleaned portion of the wall.

In one embodiment, a bottom hole assembly for use in a wellbore includes a downhole tool; and a cleaning tool coupled to the downhole tool for cleaning a portion of a wall of the wellbore. In one example, the cleaning tool includes a body; and a plurality of cleaning elements for cleaning the portion of the wall, wherein the downhole tool is configured to engage the cleaned portion of the wall.

In one embodiment, a bottom hole assembly for use in a wellbore includes a whipstock; a downhole tool coupled to the whipstock; and a cleaning tool coupled to the downhole tool for cleaning a portion of a wall of the wellbore, wherein the downhole tool is configured to engage the cleaned portion of the wall. In one example, the cleaning tool includes a body and a plurality of cleaning elements for cleaning the portion of the wall.

In one or more of the embodiments described herein, the cleaning tool includes a plurality of pockets formed in the body; and the plurality of cleaning elements disposed in the plurality of pockets and movable between a retracted position and an extended position.

In one or more of the embodiments described herein, the cleaning tool includes a biasing member for biasing the plurality of cleaning elements to the extended position.

In one or more of the embodiments described herein, the plurality of cleaning elements is hydraulically actuated.

In one or more of the embodiments described herein, the cleaning tool includes a hydraulically actuated piston configured to move the plurality of cleaning elements to the extended position.

In one or more of the embodiments described herein, the piston includes an actuating profile for engaging a mating profile of each cleaning element.

In one or more of the embodiments described herein, each cleaning element is coupled to a guide using a biasing member.

In one or more of the embodiments described herein, the cleaning elements include a scraping profile.

In one or more of the embodiments described herein, the scraping profile comprises raised edges.

In one or more of the embodiments described herein, the downhole tool comprises an anchor having a slip, and the plurality of cleaning elements are axially aligned with the slip of the anchor.

In one or more of the embodiments described herein, the plurality of cleaning elements are threadedly attached to the body.

In one or more of the embodiments described herein, the plurality of cleaning elements comprises bristles.

In one or more of the embodiments described herein, a height of the cleaning elements is adjustable.

In one or more of the embodiments described herein, the cleaning tool includes a centralizer disposed around the body, the centralizer having a plurality of bow springs; and the plurality of cleaning elements disposed on the plurality of bow springs.

In one or more of the embodiments described herein, the plurality of cleaning elements comprises scrapers.

In one or more of the embodiments described herein, the downhole tool comprises an anchor.

In one or more of the embodiments described herein, a milling tool releasably connected to the whipstock.

In one or more of the embodiments described herein, the BHA includes a packer.

In one or more of the embodiments described herein, the packer is configured to engage the cleaned portion of the wall.

In one or more of the embodiments described herein, the downhole tool comprises a packer.

In one or more of the embodiments described herein, the cleaning tool is integral with the downhole tool.

In one embodiment, a method of positioning a bottom hole assembly in a wellbore includes lowering the bottom hole assembly into the wellbore, the bottom hole assembly having a whipstock, a downhole tool, and a cleaning tool having a cleaning element; cleaning at least a portion of a wall of the wellbore using the cleaning tool; and activating the downhole tool to engage the cleaned portion of the wall.

In one or more of the embodiments described herein, the cleaning element is movable between a retracted position and an extended position.

In one or more of the embodiments described herein, the cleaning element is lowered into the wellbore in the extended position.

In one or more of the embodiments described herein, the cleaning element is lowered into the wellbore in the retracted position, and the method includes moving the cleaning element to the extended position to clean the portion of the wall.

In one or more of the embodiments described herein, the cleaning element is biased to the extended position.

In one or more of the embodiments described herein, the method includes supplying hydraulic fluid to move the cleaning element to the extended position.

In one or more of the embodiments described herein, the method includes engaging the cleaning element with an actuating profile of a piston to move the cleaning element between the retracted position and the extended position.

In one or more of the embodiments described herein, the downhole tool comprises an anchor.

In one or more of the embodiments described herein, the method includes axially aligning the cleaning element with a slip of the anchor.

In one or more of the embodiments described herein, the method includes orienting the whipstock before setting the anchor.

In one or more of the embodiments described herein, the whipstock is oriented after cleaning the wellbore.

In one or more of the embodiments described herein, the whipstock is oriented before cleaning the wellbore.

In one or more of the embodiments described herein, the bottom hole assembly includes a packer, and the method further comprises activating the packer to engage the cleaned portion of the wall.

In one or more of the embodiments described herein, the downhole tool comprises a packer.

In one or more of the embodiments described herein, wherein cleaning the portion of the wall comprises reciprocating the cleaning tool.

In one or more of the embodiments described herein, wherein cleaning the portion of the wall further comprises rotating the cleaning tool while reciprocating.

In one or more of the embodiments described herein, wherein cleaning the portion of the wall further comprises rotating the cleaning tool and further reciprocating the cleaning tool.

In one or more of the embodiments described herein, the method includes circulating fluid while cleaning.

While the foregoing is directed to embodiments of the present disclosure, other and further embodiments of the disclosure may be devised without departing from the basic scope thereof, and the scope thereof is determined by the claims that follow.

The invention claimed is:

1. A method of positioning a bottom hole assembly in a wellbore, comprising:

lowering the bottom hole assembly into the wellbore, the bottom hole assembly having a whipstock, a downhole tool coupled to the whipstock, and a cleaning tool coupled to the downhole tool, the cleaning tool having:

a body having a central bore and a plurality of side bores in fluid communication with the central bore; and a plurality of cleaning elements hydraulically actuatable to an extended position;

cleaning at least a portion of a wall of the wellbore using the cleaning tool; and orienting the whipstock in the wellbore; and setting an anchor of the downhole tool after orienting the whipstock by activating the downhole tool to engage the cleaned portion of the wall.

2. The method of claim 1, wherein the plurality of cleaning elements is movable between a retracted position and an extended position.

3. The method of claim 2, wherein lowering the bottom hole assembly into the wellbore comprises lowering the plurality of cleaning elements into the wellbore in the retracted position, and wherein cleaning using the cleaning tool includes moving the plurality of cleaning elements to the extended position to clean the portion of the wall.

4. The method of claim 2, wherein the plurality of cleaning elements is biased to the extended position.

5. The method of claim 2, further comprising supplying hydraulic fluid to move the plurality of cleaning elements to the extended position.

6. The method of claim 5, further comprising engaging the plurality of cleaning elements with an actuating profile of a piston to move the plurality of cleaning elements between the retracted position and the extended position.

7. The method of claim 1, wherein the method includes axially aligning the plurality of cleaning elements with a slip of the anchor.

8. The method of claim 1, wherein orienting the whipstock comprises orienting the whipstock after cleaning the wellbore and/or before cleaning the wellbore.

9. The method of claim 1, wherein the bottom hole assembly further comprises a packer and the method further comprises activating the packer to engage the cleaned portion of the wall.

10. The method of claim 1, wherein cleaning the portion of the wall comprises at least one of:

reciprocating the cleaning tool;

rotating the cleaning tool while reciprocating;

rotating the cleaning tool and further reciprocating the cleaning tool; and circulating fluid while cleaning.

11. A method of positioning a bottom hole assembly in a wellbore, comprising:

lowering the bottom hole assembly into the wellbore, the bottom hole assembly having a whipstock, a downhole tool coupled to the whipstock, and a cleaning tool coupled to the downhole tool, wherein the cleaning tool comprises:

a body having a central bore and a plurality of side bores in fluid communication with the central bore;

a plurality of cleaning elements hydraulically actuatable to an extended position;

a guide connected to each of the plurality of cleaning elements and disposed in a respective side bore; and a biasing member disposed around the guide for biasing the plurality of cleaning elements to a retracted position;

cleaning at least a portion of a wall of the wellbore using the cleaning tool; and activating the downhole tool to engage the cleaned portion of the wall.

12. The method of claim 11, wherein the downhole tool comprises an anchor; and wherein activating the downhole tool to engage the cleaned portion of the wall comprises setting the anchor.

13. The method of claim 12, wherein the method includes axially aligning the plurality of cleaning elements with a slip of the anchor.

14. The method of claim 12, further comprising orienting the whipstock in the wellbore before setting the anchor.

15. The method of claim 11, wherein the downhole tool comprises a packer; and wherein activating the downhole tool to engage the cleaned portion of the wall comprises activating the packer.

16. The method of claim 11, wherein the plurality of cleaning elements is movable between a retracted position and an extended position.

17. The method of claim 16, wherein lowering the bottom hole assembly into the wellbore comprises lowering the plurality of cleaning elements into the wellbore in the retracted position; and wherein cleaning using the cleaning tool includes moving the plurality of cleaning elements to the extended position to clean the portion of the wall.

18. The method of claim 16, wherein the plurality of cleaning elements is biased to the extended position.

19. The method of claim 16, further comprising supplying hydraulic fluid to move the plurality of cleaning elements to the extended position.

20. The method of claim 19, further comprising engaging the plurality of cleaning elements with an actuating profile of a piston to move the plurality of cleaning elements between the retracted position and the extended position.

21. The method of claim 11, further comprising:

orienting the whipstock after cleaning the wellbore; and/or orienting the whipstock before cleaning the wellbore.

22. The method of claim 11, wherein cleaning the portion of the wall comprises at least one of:

reciprocating the cleaning tool;

rotating the cleaning tool while reciprocating;

rotating the cleaning tool and further reciprocating the cleaning tool; and circulating fluid while cleaning.

* * * * *